US011313216B2

(12) United States Patent
Crkvenjakov et al.

(10) Patent No.: US 11,313,216 B2
(45) Date of Patent: Apr. 26, 2022

(54) AUTOMATED EVALUATION AND FINGERPRINTING OF DRILLING OPERATIONS UTILIZING REAL-TIME DATA

(71) Applicant: Chevron U.S.A. Inc., San Ramon, CA (US)

(72) Inventors: Vladimir Crkvenjakov, Conroe, TX (US); Benjamin Ames Leonard, Houston, TX (US); Ian S. Smith, Houston, TX (US); Kevin Kaczorowski, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 17/083,645

(22) Filed: Oct. 29, 2020

(65) Prior Publication Data

US 2021/0131257 A1 May 6, 2021

Related U.S. Application Data

(60) Provisional application No. 62/930,067, filed on Nov. 4, 2019.

(51) Int. Cl.

| | |
|---|---|
| ***E21B 47/002*** | (2012.01) |
| ***E21B 44/00*** | (2006.01) |
| ***E21B 45/00*** | (2006.01) |

(52) U.S. Cl.

CPC ..... *E21B 44/00* (2013.01); *E21B 45/00* (2013.01); *E21B 47/0025* (2020.05)

(58) Field of Classification Search

CPC ..... E21B 47/0025; E21B 45/00

USPC ..... 702/9

See application file for complete search history.

(56) References Cited

U.S. PATENT DOCUMENTS

| | | | | |
|---|---|---|---|---|
| 4,608,673 | A * | 8/1986 | Lazear | G01V 1/364 367/38 |
| 4,901,244 | A * | 2/1990 | Szeto | G01R 23/16 324/76.21 |
| 5,740,036 | A * | 4/1998 | Ahuja | G01V 1/368 702/17 |
| 2009/0327330 | A1* | 12/2009 | Abouzied | G06F 16/2453 |
| 2015/0233866 | A1* | 8/2015 | Verenchikov | H01J 49/40 250/282 |
| 2020/0265615 | A1* | 8/2020 | Di Santo | E21B 49/00 |
| 2020/0301036 | A1* | 9/2020 | Ramfjord | G01V 99/00 |
| 2021/0335020 | A1* | 10/2021 | Lastra | E21B 47/0025 |

* cited by examiner

*Primary Examiner* — Albert K Wong

(74) *Attorney, Agent, or Firm* — Esplin & Associates, PC

(57) ABSTRACT

Real-time data of drilling operations may be utilized to automatically fingerprint and evaluate their values to create enhanced information of interest. Enhanced information of interest may be comparable to given procedure and may facilitate generation of actionable insight and validation of procedural compliance. Real-time data of drilling operations may be analyzed to generate analysis and graphical comparison of specific sub-step operations that make up activities of interest. These operations may correspond to specific actions a driller on a rig may take to manipulate equipment and may be documented as procedural steps.

20 Claims, 18 Drawing Sheets

300

410

420

430

440

450

460

510

| Name | Unit | Definition |
|---|---|---|
| t_drill off WOB start | hh:mm:ss | Time when drill off starts |
| t_drill off WOB end | hh:mm:ss | Time when drill off ends |
| t_drill off WOB 50% | hh:mm:ss | Time when drilled off 50% of WOB |
| x_drill off WOB start | Klbm | AVG WOB value when drill off starts |
| x_drill off WOB end | Klbm | WOB value when drill off ends |
| x_drill off WOB 50% | Klbm | Value of WOB if drilled of 50% |
| t_drill off RPM start | hh:mm:ss | Time when drill off RPM start |
| t_drill off RPM end | hh:mm:ss | Time when drill off RPM ends |
| t_drill off RPM 50% | hh:mm:ss | Time when drilled off 50% of RPM value |
| x_drill off RPM start | 1/min | RPM value when drill off starts |
| x_drill off RPM end | 1/min | RPM value when drill off ends |
| x_drill off RPM 50% | 1/min | Value of RPM if drilled of 50% RPM |
| t_backream activity start | hh:mm:ss | Time when back ream starts |
| x BlockComp_backream activity start | ft | Value of block pos. when back ream starts |
| t_backream activity end | hh:mm:ss | Time when back ream end |
| x BlockComp _backream activity end | ft | Value of block pos. when back ream end |
| t_ream activity start | hh:mm:ss | Time when ream starts |
| x BlockComp _ream activity start | ft | Value of block pos. when ream starts |
| t_ream activity end | hh:mm:ss | Time when ream end |
| x BlockComp _ream activity end | ft | Value of block pos. when ream end |
| t_wash up activity start | hh:mm:ss | Time when wash up starts |
| x BlockComp _wash up activity start | ft | Value of block pos. when wash up starts |
| t_wash up activity end | hh:mm:ss | Time when wash up end |
| x BlockComp _wash up activity end | ft | Value of block pos. when wash up end |
| t_wash down activity start | hh:mm:ss | Time when wash down starts |
| x BlockComp _wash down activity start | ft | Value of block pos. when wash down starts |
| t_wash down activity end | hh:mm:ss | Time when wash down end |
| x BlockComp _wash down activity end | ft | Value of block pos. when wash down end |
| t_pick up activity start | hh:mm:ss | Time when Pick up starts |
| x BlockComp _pick up activity start | ft | Value of block pos. when Pick up starts |
| t_pick up activity end | hh:mm:ss | Time when wash Pick up end |
| x BlockComp _pick up activity end | ft | Value of block pos. when Pick up end |
| t_slack off activity start | hh:mm:ss | Time when slack off starts |
| x BlockComp _slack off activity start | ft | Value of block pos. when slack off starts |
| t_slack off activity end | hh:mm:ss | Time when wash slack off end |
| x BlockComp _slack off activity end | ft | Value of block pos. when slack off end |
| t_rotation and pump_static | hh:mm:ss | Time while static, rotating and pumping |
| t_pump_static | hh:mm:ss | Time while static and pumping |
| t_static | hh:mm:ss | Time while static |
| t_Pump off start | hh:mm:ss | Time when pumps shut down starts |
| t_Pump off end | hh:mm:ss | Time when pumps shut down end |
| x_Bitdepth value_when on slips | Ft | Bit depth value when string on slips |
| x_Hook Load_HKL_BRD_when pick off bottom | Klbm | Hook load value when break over while PU |

FIG. 5A

520

| Name | Unit | Definition |
|---|---|---|
| t_on slips start | hh:mm:ss | Time when string on slips |
| t_on slips end | hh:mm:ss | Time when string picked up off the slips |
| t_block start move | hh:mm:ss | Time when block start moving |
| t_block stop move | hh:mm:ss | Time when block stopped moving |
| x_block start move | Ft | Value of block pos. when block start move |
| x_block stop move | Ft | Value of block pos. when block stop move |
| t_TRQ increase | hh:mm:ss | Time when TRQ start increase during S2S |
| t_pumps start | hh:mm:ss | Time when pumps start during S2S |
| t_pump at max value | hh:mm:ss | Time when pump reach max value |
| t_off the slips | hh:mm:ss | Time when string is off the slips |
| x_max pumps | Gpm | Value of pumps when pump max reached |
| x_block position 1 at off slip time | Ft | Block pos. value when off slips |
| x_block position 2 after off slip time | Ft | Block pos. value when after off slips |
| t_start RPM | hh:mm:ss | Time when RPM started during S2W |
| x_RPM value 1 – at 1st step up_IF | 1/min | RPM value if RPM stepped up |
| x_RPM value 2 – at start drilling | 1/min | RPM value when but back on bottom |
| x_RPM value 3 – after 1 min of drilling | 1/min | RPM value after 1 min of drilling |
| t_bit depth at bottom | hh:mm:ss | Time when bit back on bottom |
| x_Bitdepth value_when on slips | Ft | Bit depth value during when on the slips |
| x_Bitdepth value_when off slips | Ft | Bit depth value when off the slips |
| x_Hook Load_HKL_Wash_when pumps on | Klbm | Hook load value when static and pumps on |
| x_Hook Load_HKL_Ream_when RPM on | Klbm | Hook load value when static, pumps and RPM on |
| x_Hook Load_HKL_1ft OB_when ream down | Klbm | Hook load value when ream down and 1 ft off bottom |
| x_SPP at start drilling | Psi | SPP value when started drilling |
| x_SPP while drilling | Psi | SPP value while drilling and when SPP stabilized |
| t_off bottom during drilling IF | hh:mm:ss | Time when/if string picked up off bottom during drilling after survey taken |
| t_back to bottom during drilling IF | hh:mm:ss | Time when/if string back to bottom during drilling after survey taken |
| x_AVG WOB value in 1st 5 min of drilling | Klbm | AVG WOB value in 1st 5 min of drilling |
| x_AVG Hookload value in 1st 5 min of drilling | Klbm | AVG Hook load value in 1st 5 min of drilling |

FIG. 5B

610

| Name | Unit | Definition |
|---|---|---|
| **Delta drill off WOB value** | Klbm | WOB drill off value |
| **Delta drill off time** | Min | WOB drill off time |
| **Delta drill off RPM value** | Klbm | RPM drill off value |
| **Delta drill RPM time** | Min | RPM drill off time |
| **Drill off 50% WOB** | True / False | If rig drill off 50% off WOB |
| **Drill off 50% WOB in 1min** | True / False | If rig drill off WOB 50% within 1 min |
| **Drill off 50% RPM** | True / False | If rig drill off 50% of RPM value |
| **Drill off 50% RPM in 1min** | True / False | If rig drill off RPM 50% within 1 min |
| **Back ream – event count** | # | Number of back ream events in W2S period |
| **Back ream - footage** | Ft | Back ream footage |
| **Ream – event count** | # | Number of ream events in W2S period |
| **Ream - footage** | Ft | Ream footage |
| **Speed of back ream** | Ft/min | Speed of back ream |
| **Speed of ream** | Ft/min | Speed of ream |
| **Back ream ranges - footage** | Ft | If more than 1 back ream interval, state ranges in feet |
| **Back ream cum. footage** | Ft | If more than 1 back ream event, sum of back ream footage |
| **Ream ranges - footage** | Ft | If more than 1 ream interval, state ranges in feet |
| **Ream cum. footage** | Ft | If more than 1 ream event, sum of back ream footage |
| **Wash up – event count** | # | Number of wash up events in W2S period |
| **Wash up - footage** | Ft | Wash up footage |
| **Wash down – event count** | # | Number of wash down events in W2S period |
| **Wash down - footage** | Ft | Wash down footage |
| **Speed of wash up** | Ft/min | Speed of wash up |
| **Speed of wash down** | Ft/min | Speed of wash down |
| **Wash up ranges - footage** | Ft | If more than 1 wash up interval, state ranges in feet |
| **Wash up cum. footage** | Ft | If more than 1 wash up event, sum of wash up footage |
| **Wash down ranges - footage** | Ft | If more than 1 wash down interval, state ranges in feet |
| **Wash down cum. footage** | Ft | If more than 1 wash down event, sum of wash down footage |
| **Pick up – event count** | # | Number of pick up events in W2S period |
| **Pick up - footage** | Ft | Pick up footage |
| **Slack off – event count** | # | Number of slack off events in W2S period |
| **Slack off - footage** | Ft | Slack off footage |
| **Speed of pick up** | Ft/min | Speed of pick up |
| **Speed of slack off** | Ft/min | Speed of slack off |
| **Pick up ranges - footage** | Ft | If more than 1 pick up interval, state ranges in feet |
| **Pick up cum. footage** | Ft | If more than 1 pick up event, sum of pick up footage |
| **Slack ranges - footage** | Ft | If more than 1 slack off interval, state ranges in feet |
| **Slack off cum. footage** | Ft | If more than 1 slack off event, sum of slack off footage |

FIG. 6A

620

| Name | Unit | Definition |
|---|---|---|
| **Rotating and washing – static time** | Min | Time while static, rotating and pumping |
| **Washing – static time** | Min | Time while static and pumping |
| **Static - time** | Min | Time while static |
| **Time to shut down pumps** | Min | Time to shut down the pumps |
| **Stick up** | Ft | Stick up value |
| **Hard pump shut down** | True / False | If pumps were shut down hard or stepped down |
| **Sip to Slip time** | Min | Slip to slip time – connection time |
| **Time to disconnect pipe** | Min | Time to disconnect pipe – from on slips till block move |
| **Time to move block** | Min | Time to move block during S2S |
| **Block Speed** | Ft/Min | Block Speed during S2S |
| **Time to stab in new pipe** | Min | Time to stab in new pipe – from block stop move till TRQ increase |
| **Time to TRQ up** | Min | Time to TRQ up – from TRQ increase till string off the slips |
| **Pump time** | Min | Pump time – time to start the pumps |
| **Hard pump start up** | True / False | If pumps were started hard or stepped up |
| **Start pumps on slips** | True / False | If pumps were started while on slips or after off the slips |
| **String Pick Up off slips** | True / False | If string was picked up off the slips as per procedure |
| **String Pick Up off slips value** | Ft | AVG string pick up off the slips value |
| **RPM start time** | Min | Time to start RPMs during S2W |
| **RPM target reached** | True / False | If targeted RPM was reached during S2W prior getting on bottom |
| **Start RPM hard** | True / False | If RPM was started hard or stepped up |
| **Reset bit depth at S2S** | True / False | If bit depth was reset toward total depth during S2S |
| **Reset bit depth at S2W** | True / False | If bit depth was reset toward total depth during S2W |
| **SPP stabilized when start drill** | True / False | If SPP was stabilized prior drilling started |
| **Tag SPP vs SPP drilling ratio** | % | Ratio of avg SPP when tagging bottom and stabilized SPP while drilling |
| **Pick up during drilling** | True / False | If string was picked up off bottom during drilling after survey was taken |
| **Pick up during drilling time** | Min | Off bottom time during drilling when/after survey is taken |
| **AVG Calculated WOB BRD** | Klbm | AVG CWOB BRD = actual Hookload-HKL_BRD |
| **AVG Calculated WOB Wash** | Klbm | AVG CWOB Wash = actual Hookload-HKL_Wash |
| **AVG Calculated WOB Ream** | Klbm | AVG CWOB Ream = actual Hookload-HKL_Ream |
| **AVG Calculated WOB 1ft OB** | Klbm | actual Hookload-HKL_1ft_OB |

FIG. 6B

700

| Name | Unit | Definition |
|---|---|---|
| **Drill off WOB compliance** | % | Number of connections that drill off WOB (%) over required time (min) |
| **Avg drill off WOB value** | Klbm | Avg drill off WOB value |
| **RPM reduction compliance** | % | Number of connections that reduced RPM (%) over required time (min) |
| **Avg RPM reduction value** | Klbm | Average RPM Reduction Value |
| **Pump stop compliance** | % | Number of connections shut down pumps per procedure, hard or step down |
| **Pump time compliance** | % | Number of connections shut down pumps prior setting string on slips |
| **Back ream/Ream compliance** | % | Number of connections that back reamed/Reamed as per procedure |
| **AVG back reamed/Reamed footage and speed** | Ft | AVG back reamed footage and speed |
| **Wash up/Washed down compliance** | % | Number of connections that washed up/Washed down as per procedure |
| **AVG wash up/washed down footage and speed** | Ft | AVG wash up footage and speed |
| **Stick up compliance** | % | Number of connections that left stick up as per procedure |
| **AVG stick up value** | Ft | AVG stick up value |
| **Bit off bottom compliance** | % | Number of connections that left bit on bottom during connection |
| **Pump start up compliance** | % | Number of connections that started pumps per procedure, hard or stepped up |
| **Pump time compliance** | % | Number of connections that started pumps during on slips |
| **PU string compliance** | | Number of connections that picked up string off the slips as per procedure |
| **AVG PU footage** | Ft | Average picked up footage after getting off the slips |
| **RPM Start Up compliance** | % | Number of connections that started RPM per procedure, hard or stepped up |
| **RPM Start Up compliance** | % | Number of connections that Bring rotary to 50% of target surface drilling RPM first |
| **Bit depth reset compliance** | % | Count of positive BD corrections during S2S and W2S |
| **Pressure compliance** | % | Number of connections that have pressure stabilized prior starting to drill |
| **Zero WOB compliance** | % | Number of connections that zeroed WOB as per procedure |
| **Pick up after survey compliance** | % | Number of connections that picked up off bottom during 1st 7 minutes of drilling after connection |
| **Pick up after survey time** | Min | Average off bottom time in 1st 7 minutes of drilling after connection |

FIG. 7

AUTOMATED EVALUATION AND FINGERPRINTING OF DRILLING OPERATIONS UTILIZING REAL-TIME DATA

CROSS-REFERENCE TO RELATED APPLICATIONS

The present application claims the benefit of U.S. Provisional Application Ser. No. 62/930,067, entitled "AUTOMATED EVALUATION AND FINGERPRINTING OF DRILLING OPERATIONS UTILIZING REAL-TIME DATA," which was filed on Nov. 4, 2019, the entirety of which is hereby incorporated herein by reference.

FIELD

The present disclosure relates generally to the field of evaluating drilling operations based on time-alignment of sub-operations of interest.

BACKGROUND

Drilling performance analytics tools provide information of limited value. Such information does not translate directly into actionable insight that would impact drilling productive and nonproductive times.

SUMMARY

This disclosure relates to automatically evaluating drilling operations. Operating information for drilling operations and/or other information may be obtained. The operating information may characterize operating values of the drilling operations for one or more time durations. A set of operation time windows within the time duration(s) may be determined. Individual operation time window may span a time portion within the time duration(s). Individual operation time window may correspond to performance of an operation of interest. The set of operation time windows may include a first operation time window, a second operation time window, and/or other operation time windows. The first operation time window may span a first time portion within the time duration(s). The first operation time window may correspond to first performance of a first operation of interest. The second operation time window may span a second time portion within the time duration(s). The second operation time window may correspond to second performance of the first operation of interest.

Performance of sub-operations of interest within the set of operation time windows may be identified. The performance of the sub-operations of interest may include first performance of a first sub-operation of interest within the first operation time window, second performance of the first sub-operation of interest within the second operation time window, and/or other performance of the first sub-operation of interest. Portions of the operating information corresponding to different performance of the sub-operations of interest may be time-aligned such that a first set of the operating values for the first performance of the first sub-operation of interest is time-aligned to a second set of the operating values for the second performance of the first sub-operation of interest. Multi-dimensional analysis of the time-aligned portions of the operating information may be performed. One or more visualizations of the drilling operations may be generated based on the multi-dimensional analysis of the time-aligned portions of the operating information, and/or other information.

A system that automatically evaluates drilling operations may include one or more electronic storage, one or more processors and/or other components. The electronic storage may store operating information, information relating to drilling operations, information relating to operating values, information relating to operation time windows, information relating to operations of interest, information relating to sub-operations of interest, information relating to time-alignment, information relating to multi-dimensional analysis, information relating to visualizations, and/or other information.

The processor(s) may be configured by machine-readable instructions. Executing the machine-readable instructions may cause the processor(s) to facilitate automatically evaluating drilling operations. The machine-readable instructions may include one or more computer program components. The computer program components may include one or more of an operating information component, an operation component, a sub-operation component, an alignment component, an analysis component, a visualization component, and/or other computer program components.

The operating information component may be configured to obtain operating information for one or more drilling operations and/or other information. The operating information component may be configured to obtain the operating information from one or more locations. The operating information may characterize operating values of the drilling operation(s) for one or more time durations.

The operation component may be configured to determine a set of operation time windows within the time duration(s). Individual operation time window may span a time portion within the time duration(s). Individual operation time window may correspond to performance of an operation of interest. The set of operation time windows may include a first operation time window, a second operation time window, and/or other operation time window. The first operation time window may span a first time portion within the time duration(s). The first operation time window may correspond to first performance of a first operation of interest. The second operation time window may span a second time portion within the time duration(s). The second operation time window may correspond to second performance of the first operation of interest.

In some implementations, determination of the set of operation time windows within the time duration(s) may include: identification in time of occurrence of individual operation of interest; and selection of a corresponding operation time window to include a first time segment, a second time segment, and/or other time segment(s) of the time duration. The first time segment may precede the occurrence of the individual operation of interest, and the second time segment may follow the occurrence of the individual operation of interest. In some implementations, the first time segment and the second time segment may be of same duration of time. In some implementations, the first time segment and the second time segment may be of different durations of time.

The sub-operation component may be configured to identify performance of sub-operations of interest within the set of operation time windows. The performance of the sub-operations of interest may include first performance of a first sub-operation of interest within the first operation time window, second performance of the first sub-operation of interest within the second operation time window, and/or other performance of the first sub-operation of interest. In some implementations, the performance of the sub-operations of interest may further include first performance of a second sub-operation of interest within the first operation time window, second performance of the second sub-operation of interest within the second operation time window, and/or other performance of the second sub-operation of interest.

The alignment component may be configured to time-align portions of the operating information corresponding to different performance of the sub-operations of interest. The portions of the operating information corresponding to different performance of the sub-operations of interest may be time-aligned such that a first set of the operating values for the first performance of the first sub-operation of interest may be time-aligned to a second set of the operating values for the second performance of the first sub-operation of interest. In some implementations, the portions of the operating information corresponding to different performance of the sub-operations of interest may be time-aligned such that a third set of the operating values for the first performance of the second sub-operation of interest may be time-aligned to a fourth set of the operating values for the second performance of the second sub-operation of interest.

In some implementations, the time-alignment of the portions of the operating information corresponding to different performance of the sub-operations of interest may include: identification in time of an anchoring point for individual sub-operation of interest; and alignment of the portions of the operating information corresponding to different performance of the sub-operations of interest such that multiple ones of the anchoring point are aligned.

The analysis component may be configured to perform multi-dimensional analysis of the time-aligned portions of the operating information, and/or other information. In some implementations, the multi-dimensional analysis of the time-aligned portions of the operating information may include analysis based on operation times, the operating values, ratios of the operating values, and/or other dimensions of the operating information. In some implementations, the multi-dimensional analysis of the time-aligned portions of the operating information may include analysis of different dimensions of the operating information based on a type of the operation of interest, a type of the sub-operation of interest, and/or other information.

The visualization component may be configured to generate one or more visualizations of the drilling operations based on the multi-dimensional analysis of the time-aligned portions of the operating information, and/or other information. In some implementations, the visualization(s) of the drilling operations may provide compliance visualization for the drilling operations. In some implementations, the visualization(s) of the drilling operations may include one or more graphs.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

BRIEF DESCRIPTION OF THE DRAWINGS

FIGS. 5A and 5B illustrate example points of interest for multi-dimensional analysis of time-aligned operating values of drilling operations.

FIGS. 6A and 6B illustrate example performance measurements determined based on one or more points of interest shown in FIGS. 5A and 5B.

FIG. 7 illustrates example procedural compliance parameters.

DETAILED DESCRIPTION

The present disclosure relates to evaluating drilling operations. Real-time data of drilling operations may be utilized to automatically fingerprint and evaluate their values to create enhanced information of interest. Enhanced information of interest may be comparable to given procedure and may facilitate generation of actionable insight and validation of procedural compliance. Real-time data of drilling operations may be analyzed to generate analysis and graphical comparison of specific sub-step operations that make up activities of interest. These operations may correspond to specific actions a driller on a rig may take to manipulate equipment and may be documented as procedural steps.

Figure 1:
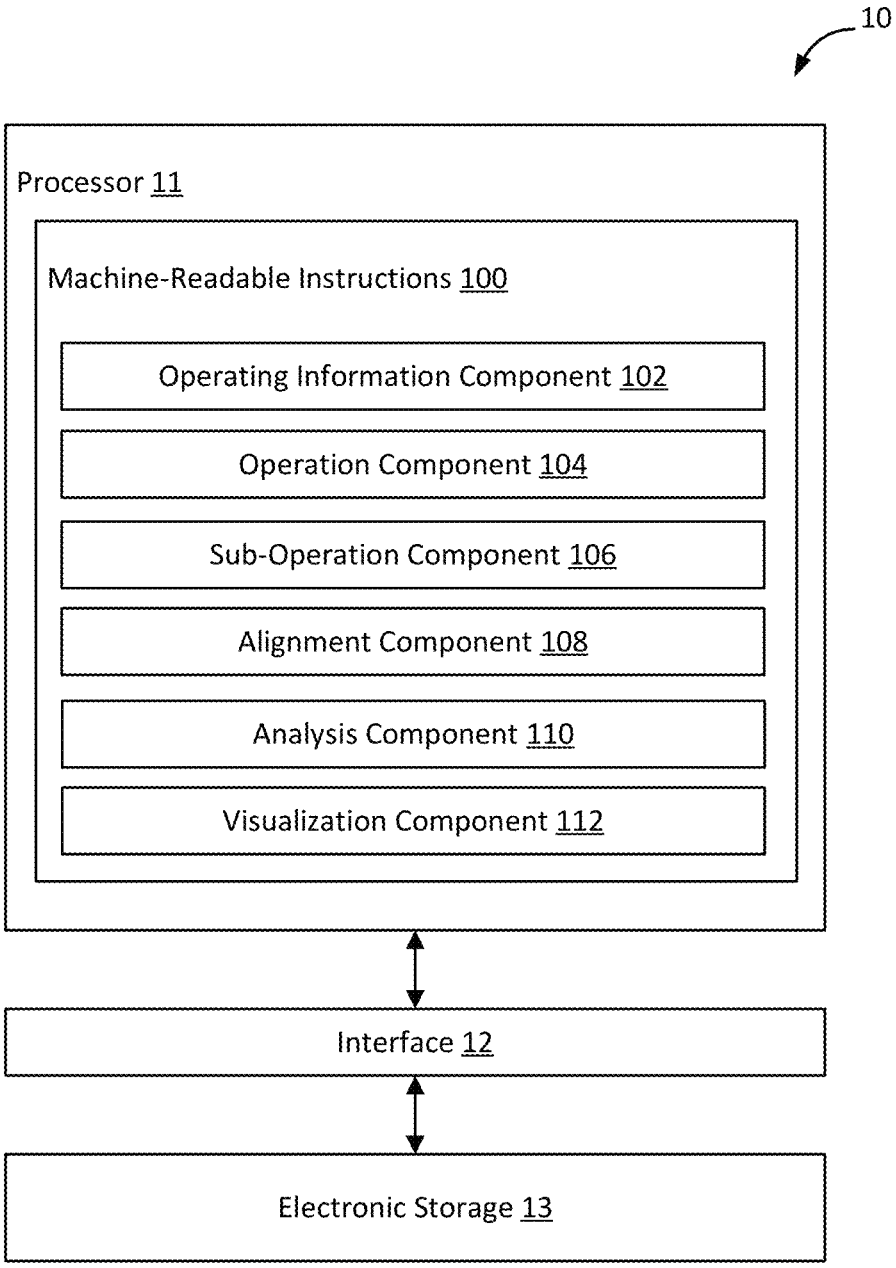
FIG. 1 illustrates an example system that automatically evaluates drilling operations.

The methods and systems of the present disclosure may be implemented by and/or in a computing system, such as a system 10 shown in FIG. 1. The system 10 may include one or more of a processor 11, an interface 12 (e.g., bus, wireless interface), an electronic storage 13, and/or other components. Operating information for drilling operations and/or other information may be obtained by the processor 11. The operating information may characterize operating values of the drilling operations for one or more time durations. A set of operation time windows within the time duration(s) may be determined by the processor 11. Individual operation time window may span a time portion within the time duration(s). Individual operation time window may correspond to performance of an operation of interest. The set of operation time windows may include a first operation time window, a second operation time window, and/or other operation time windows. The first operation time window may span a first time portion within the time duration(s). The first operation time window may correspond to first performance of a first operation of interest. The second operation time window may span a second time portion within the time duration(s). The second operation time window may correspond to second performance of the first operation of interest.

Performance of sub-operations of interest within the set of operation time windows may be identified by the processor 11. The performance of the sub-operations of interest may include first performance of a first sub-operation of interest within the first operation time window, second performance of the first sub-operation of interest within the second operation time window, and/or other performance of the first sub-operation of interest. Portions of the operating information corresponding to different performance of the sub-operations of interest may be time-aligned by the processor 11 such that a first set of the operating values for the first performance of the first sub-operation of interest is time-aligned to a second set of the operating values for the second performance of the first sub-operation of interest. Multi-dimensional analysis of the time-aligned portions of the operating information may be performed by the processor 11. One or more visualizations of the drilling operations may be generated by the processor 11 based on the multi-dimensional analysis of the time-aligned portions of the operating information, and/or other information.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store operating information, information relating to drilling operations, information relating to operating values, information relating to operation time windows, information relating to operations of interest, information relating to sub-operations of interest, information relating to time-alignment, information relating to multi-dimensional analysis, information relating to visualizations, and/or other information.

The processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate automatically evaluating drilling operations. The machine-readable instructions 100 may include one or more computer program components. The machine-readable instructions 100 may include one or more of an operating information component 102, an operation component 104, a sub-operation component 106, an alignment component 108, an analysis component 110, a visualization component 112, and/or other computer program components.

The operating information component 102 may be configured to obtain operating information for one or more drilling operations and/or other information. Obtaining operating information may include one or more of accessing, acquiring, analyzing, determining, examining, identifying, loading, locating, opening, receiving, retrieving, reviewing, selecting, storing, utilizing, and/or otherwise obtaining the operating information. The operating information component 102 may be configured to obtain the operating information from one or more locations. For example, the operating information component 102 may obtain operating information from a storage location, such as the electronic storage 13, electronic storage of a device accessible via a network, and/or other locations. The operating information component 102 may obtain operating information from one or more hardware components (e.g., a computing device, a component of a computing device, a sensor, a component of a drilling tool) and/or one or more software components (e.g., software running on a computing device). Operating information may be stored within a single file or multiple files.

The operating information component 102 may be configured to obtain the operating information at once and/or in parts. For example, the operating information component 102 may obtain entirety of the operating information before analyzing the operating information. The operating information component 102 may obtained portions of the operating information that are needed in stages. For instance, the operating information component 102 may obtain a portion of the operating information to be used to determine an operation time window. The operating information component 102 may then obtain additional operating information about the drilling operation(s) within the operation time window.

The operating information may characterize operating values of the drilling operation(s) for one or more time durations. A time duration may include the duration(s) of time during or within which one or more drilling operation are performed. A time duration may include performance of a single drilling operation or multiple drilling operations. A drilling operation may refer to a performance of work and/or activity to drill one or more holes, such as one or more holes into the ground. A drilling operation may involve usage of one or more drilling tools. A drilling operation may include one or more general usage and/or particular usage of the drilling tool(s). For example, the operating information may characterize operating values of frequent and/or specific drilling operations. A drilling tool may refer to a device or an implement designed and/or used for drilling. A drilling tool may be designed and/or used to drill one or more substances. For example, a drilling tool may include a rock drilling tool for drilling into and/or through rock (e.g., sedimentary rock). A drilling tool to may refer to one or more portions of a device/implement that performs the drilling. A drilling tool may refer to portions of or entirety of a device/implement that performs drilling. For example, a drilling tool may refer to one or more portions of a drilling rig and/or the entirety of the drilling rig. Other drilling tools are contemplated.

Operating values of a drilling operation may refer to values (e.g., continuous values, categorical values) of one or more parameters/parameter values of the drilling tool(s) used for the drilling operation. Operating values of a drilling operation may be recorded/determined as a function of time over the time duration(s). For example, operating values of a drilling operation may include parameter(s)/parameter value(s) of the drilling tool(s) that are controlled and/or set to operate the drilling tool(s) in a particular manner and perform the drilling operation. Operating values of a drilling operation may include parameter(s)/parameter value(s) of the drilling tool(s) that indicate how the drilling tool(s) were used during the drilling operation. Operating values of a drilling operation may include one or more values of environmental condition(s) of and/or near the drilling tool(s). For instance, operating values of a drilling operation may include drilling rig operation values, such as values of block position, flow rate, surface RPM, hook load, standpipe pressure, weight on bit, bit depth, drilling tool state (e.g., drilling rig state), drilling depth, drilling stress, and/or other operating values of the drilling operation.

The operating information may characterize operating values of a drilling operation by including information that characterizes (e.g., reflects, quantifies, identifies, defines) one or more values, qualities, attributes, features, and/or other aspects of the operating values. For example, the operating information may characterize operating values of a drilling operating information by including information that makes up and/or is used to determine values, characters, and/or symbols of the operating values. For instance, the operating information may include time-indexed drilling rig sensor data. Other types of operating information are contemplated.

Conventional drilling performance analytic tools may provide information of limited value regarding drilling operations. For example, such tools may provide information on total lengths of time required to perform drilling operations or identify variations in times required to perform drilling operations. However, information provided by these tools may not translate directly into actionable insights, such as to improve drilling productive and non-productive times. Information provided by these tools may require manual manipulation (e.g., data manipulation) from users to analyze drilling performance.

To overcome these deficiencies, relevant portions of drilling operation data may be identified and time-aligned to perform multi-dimensional analysis. Digital fingerprints may be generated from drilling operations data to evaluate drilling operations. Performances of the same drilling operation may be compared to each other and/or evaluated for procedural compliance and/or recommended practices generation.

The operation component 104 may be configured to determine a set of operation time windows within the time duration(s). Determining a set of operation time windows may include one or more of selecting, ascertaining, deciding, establishing, identifying, and/or otherwise determining the set of operation time windows. In some implementations, the set of operation time windows may be determined based on the operating information and/or other information. For example, the operating information may include information of different states of the drilling tool and the operation component 104 may use the states of the drilling tool to identify the set of operation time windows. The operating information may include operating values of different drilling tool parameters, and the operation component 104 may determine the set of operation time windows based on analysis of the operating values. For instance, the operation component 104 may determine the set of operation time window based on particular drilling tool parameter value(s), particular combination(s) of drilling tool parameter value(s), particular pattern(s) of drilling tool parameter value(s), and/or other analysis of the drilling tool parameter value(s).

A set of operation time window may include one or more operation time windows. An operation time window may refer to a window that covers a portion of the time duration(s). Individual operation time window may span a time portion within the time duration(s). The size of the time windows may be the same or different. For example, a set of operation time window may include multiple operation time windows that span the same length of time. A set of operation time window may include multiple operation time windows that span different lengths of time A time portion spanned by an operation time window may include the portion of time during within an operation of interest is performed. That is, individual operation time window may correspond to performance of an operation of interest. An operation of interest may refer to a drilling operation that is of interest to one or more users. An operation of interest may refer to a drilling operation that impacts drilling productive and/or nonproductive times. An operation of interest may refer to a particular operation, an operation that includes a number of other operations, and/or an operation that is related to other operations (e.g., an operation preceding, following, and/or surrounded by related operations; an operating to identify a sequence of related operations). These operations may be included within the time portion spanned by the operation time window. For example, an operation of interest may include making a connection, which may be preceded by one or more pre-connection operations and/or followed by one or more post-connection operations. The pre-connection operations and/or post-connection operations may be included within the time portion spanned by the operation time window for the connection. While the details of the disclosure are described with respect to making a connection, this is merely as an example and is not meant to be limiting. The techniques described herein may be applied to other operations of interest.

The set of operation time windows may include multiple operation time windows, with individual operation time window corresponding to separate performance of the operation of interest. For example, the set of operation time windows may include a first operation time window, a second operation time window, and/or other operation time window. The first operation time window may span one time portion within the time duration(s), and may correspond to a performance of an operation of interest. The second operation time window may span another time portion within the time duration(s), and may correspond to another (different, separate) performance of the operation of interest. The determination of the operation time windows may effectuate selection of time portions corresponding to performance of the operation of interest within the time duration(s) of the operating information.

Figure 3:
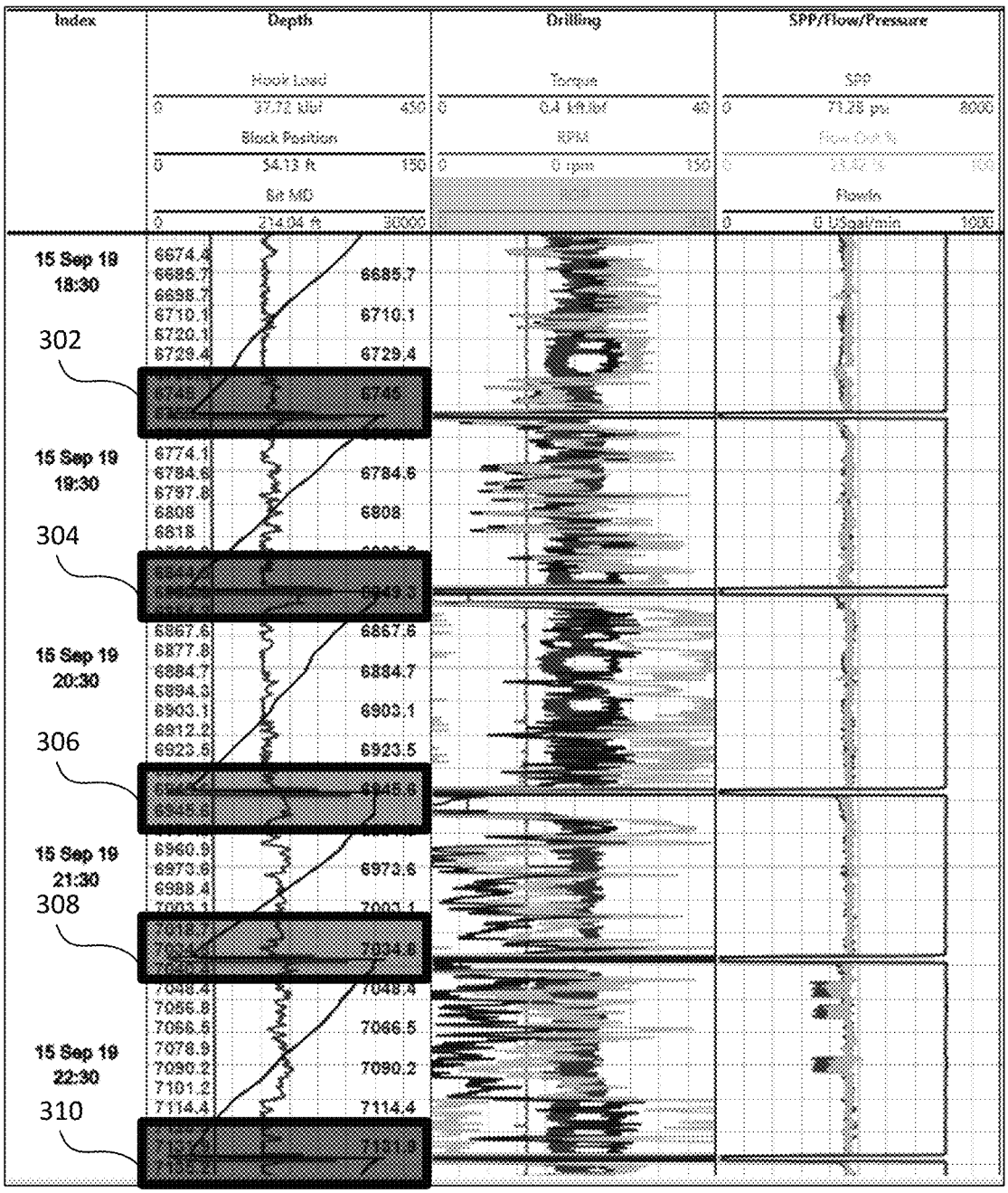
FIG. 3 illustrates example plots of operating values of drilling operations and operation time windows.

FIG. 3 illustrates example plots 300 of operating values of drilling operations and operation time windows, 302, 304, 306, 308, 310. The plots 300 may illustrate values of hook load, block position, bit measured depth, torque, revolutions per minute, rate of penetration, standpipe pressure, flow out, and flow in for drilling operations. The plots 300 may illustrates the values for a time duration (e.g., from/around Sep. 15, 2019 at 18:30 to/around Sep. 15, 2019 at 22:30). The operation time windows 302, 304, 306, 308, 310 may be determined within the time duration shown in the plots 300. The operation time windows 302, 304, 306, 308, 310 may span different time portions within the time duration. Individual operation time windows 302, 304, 306, 308, 310 may correspond to performance of an operation of interest. For example, Individual operation time windows 302, 304, 306, 308, 310 may correspond to performance of making a connection. The determination of the operation time windows 302, 304, 306, 308, 310 may effectuate selection of the time portions corresponding to performance of making connections within the time duration. Such selection of the time portions may effectuate data selection for analysis. Such selection of the time portions may filter out erroneous and/or problematic data (e.g., noise) from analysis.

In some implementations, determination of the set of operation time windows within the time duration(s) may include identification in time of occurrence of individual operations of interest, and selection of corresponding operation time windows based on the identified time of occurrence. The corresponding operation time window may be selected to include a time segment preceding the identified time of occurrence and/or a time segment following the identified time of occurrence. For example, the identified time of occurrence may indicate the starting time point of the operation time window, and the operation time window may be determined to include a time segment that follows the identified time of occurrence. The identified time of occurrence may indicate the ending time point of the operation time window, and the operation time window may be determined to include a time segment that precedes the identified time of occurrence. The identified time of occurrence may indicate a time point within the operation time window, and the operation time window may be determined to include a time segment that precedes the identified time of occurrence and a time segment that follows the identified time of occurrence (e.g., selecting a time window that includes time amounts before and after the time of occurrence). The preceding time segment and the following time segment may be of same duration of time or different durations of time. For instance, the identified time of occurrence may include a time at which the connection is made, and the operation time window may be determined to include ten to fifteen minutes before and ten to fifteen minutes after the connection is made (e.g., middle point of slip-to-slip operation). Such determination of the time window may enable analysis of drilling operations related to/that affects drilling connection, such as pre-connection and post-connection operations.

In some implementations, the operation time window may be determined based on the identified time of occurrence and the operating information. Portions of the operating information within certain time segment(s) of the identified time of occurrence may be analyzed to identify the operation time window. That is, rather than including within the operation time window set time amounts before and/or after the identified time of occurrence, certain time amounts before and/or after the identified time of occurrence may be used as possible starting and/or ending points for the operation time window. For example, the identified time of occurrence may indicate the starting time point of the operation time window, and the operation time window may be determined based on analysis of operating information for a time segment that follows the identified time of occurrence. The identified time of occurrence may indicate the ending time point of the operation time window, and the operation time window may be determined based on analysis of operating information for a time segment that precedes the identified time of occurrence. The identified time of occurrence may indicate a time point within the operation time window, and the operation time window may be determined based on analysis of operating information for a time segment that precedes the identified time of occurrence and a time segment that follows the identified time of occurrence. Such determination of the time window may enable the time window to span flexible time durations based on the operating information. In some implementations, minimum and/or maximum time spans may be set for analysis. The minimum time span may place a limit on the smallest time duration that may be spanned by a time segment before or after the identified time of occurrence. The maximum time span may place a limit on the largest time duration that may be spanned by a time segment before or after the identified time of occurrence.

In some implementations, different types of operation of interest may be associated with different operation time window or different determinations of operation time windows. For example, whether the operation time window is determined to include time segment(s) before and/or after the identified time of occurrence and/or the amount of time spanned by the time segment(s)/amount of time segments to be taken into account in operating information analysis may be determined based on the type of the operation of interest.

In some implementations, information may be obtained and/or information processing may be performed based on the set of operation time windows. For example, based on a determination of an operating time window, information characterizing operating values of the drilling operation for the time spanned by the operating time window may be obtained. For instance, for individual operating time windows, operating information characterizing block position, flow rate, surface RPM, hook load, standpipe pressure, weight on bit, bit depth, drilling depth, drilling stress, and/or other operating values of the drilling operation may be obtained. Quality assurance/quality control processing may be performed on the obtained operating information to prepare the information for analysis. For instance, values may be converted into one or more standards, erroneous values may be replaced with empty values, and data frequency may be reviewed to create/arrange data at equal interviews (e.g., create equal five-second intervals, interpolate missing data points). Other information processing is contemplated.

The sub-operation component 106 may be configured to identify performance of sub-operations of interest within the set of operation time windows. A sub-operation of interest may refer to an operation of interest within an operation time window. A sub-operation of interest may refer to a drilling operation related to the operation of interest corresponding to an operation time window. For example, the operation of interest corresponding to the operation time window may include making a connection, and a sub-operation of interest may include a pre-connection operation or a post-connection operation. A sub-operation of interest may refer to a part of the operation of interest corresponding to an operation time window. For example, the operation of interest corresponding to the operation time window may include making a connection, and a sub-operation of interest may refer to a part of the connection-making operation. For instance, to make a connection, multiple operations may need to be performed and a sub-operation may refer to one of those multiple operations.

The sub-operation component 106 may be configured to identify performance of particular sub-operations of interest within different operation time windows. For example, referring to FIG. 3, the sub-operation component 106 may identify, within individual operation time windows 302, 304, 306, 308, 310, performance of different sub-operations. For example, the sub-operation component 106 may identify performance of a particular sub-operation of interest within the operation time windows 302, 304, 306, 308, 310, and may identify performance of a different sub-operation of interest within the operation time windows 302, 304, 306, 308, 310. The identified performance of the sub-operations of interest may be used to determine relevant portions of the operating information for analysis (e.g., break apart time-indexed drilling rig sensor data into a series of discrete events for analysis).

The alignment component 108 may be configured to time-align portions of the operating information corresponding to different performance of the sub-operations of interest. Time-aligning portions of the operating information corresponding to different performance of the sub-operations of interest may include aligning different sets of operating values for the sub-operations of interest based on the time at which the sub-operations are performed. For example, the operating information may include time-indexed drilling rig sensor data and different portions of the drilling rig sensor data may be aligned so that the data is time-aligned for comparison. The data may be time-aligned to the start, the middle, the end, and/or other time points of the performance of the sub-operations of interest.

For example, performance of a pre-connection operation and a post-connection operation may be identified within two operation time windows. The alignment component 108 may time-align portions of the operating information corresponding to different performance of the pre-connection operations such that a set of operating values for (including one or more operating values that characterize, reflect, quantify, identify) the performance of the pre-connection operation within the first operation time window is aligned to a set of operating values for the performance of the pre-connection operation within the second operation time window. The alignment component 108 may time-align portions of the operating information corresponding to different performance of the post-connection operations such that a set of operating values for the performance of the post-connection operation within the first operation time window is aligned to a set of operating values for the performance of the post-connection operation within the second operation time window. Such time-alignment of the operating information portions may enable comparison/analysis of different/separate performance of the sub-operations of interest.

In some implementations, the time-alignment of the portions of the operating information corresponding to different performance of the sub-operations of interest may by performed based on identification of one or more anchoring points for individual sub-operations of interest. An anchoring point may refer to a time-point to which different portions of the operating information are aligned. Multiple anchoring points identified for different performance of the sub-operations of interest may be aligned to perform time-alignment of the portions of the operating information.

For example, for individual pre-connection operations, the time of a weight-to-slip (W2S) anchoring point may be identified. The time of the weight-to-slip anchoring point may be identified as the time when a corresponding bit is picked up off the bottom after stand is drilled down. For individual post-connection operations, the time of a slip-to-weight (S2W) anchoring point may be identified. The time of the slip-to-weight anchoring point may be identified as the time when a corresponding string is picked up off the slip after connection is made. The time-alignment of portions of the operating information corresponding to different performance of the pre-connection operations may be performed based on the W2S anchoring points of the individual performances such that the W2S anchoring points are aligned. The time-alignment of portions of the operating information corresponding to different performance of the post-connection operations may be performed based on the S2W anchoring points of the individual performances such that the S2W anchoring points are aligned.

Aligning the portions of the operating information to the anchoring points may result in the different sets of operating values being superimposed on top of each other. For example, different portions of the time-indexed drilling rig sensor may be aligned by aligning the corresponding anchoring points. For instance, the anchoring points may be identified for start of the pre/post-connection operations, and the portions of the operating information may be aligned to the anchoring points so that the time-indexed values overlap from the beginning of the operations.

FIGS. 4A, 4B, 4C, 4D, 4E, and 4F illustrate example time-aligned plots 410, 420, 430, 440, 450, 460 of operating values of drilling operations. The values of the time-aligned plots 410, 420, 430, 440, 450, 460 may reflect operating values from five different connection operations within the operation time windows 302, 304, 306, 308, 310 (shown in FIG. 3). These values may have been aligned to one or more anchoring points, such as the W2S anchoring point, to generate the time-aligned plots 410, 420, 430, 440, 450, 460. The time of the W2S anchoring point may be shown as dashed lines in the time-aligned plots 410, 420, 430, 440, 450, 460, and may correspond to a zero time value in the time-aligned plots 410, 420, 430, 440, 450, 460.

Figure 4A:
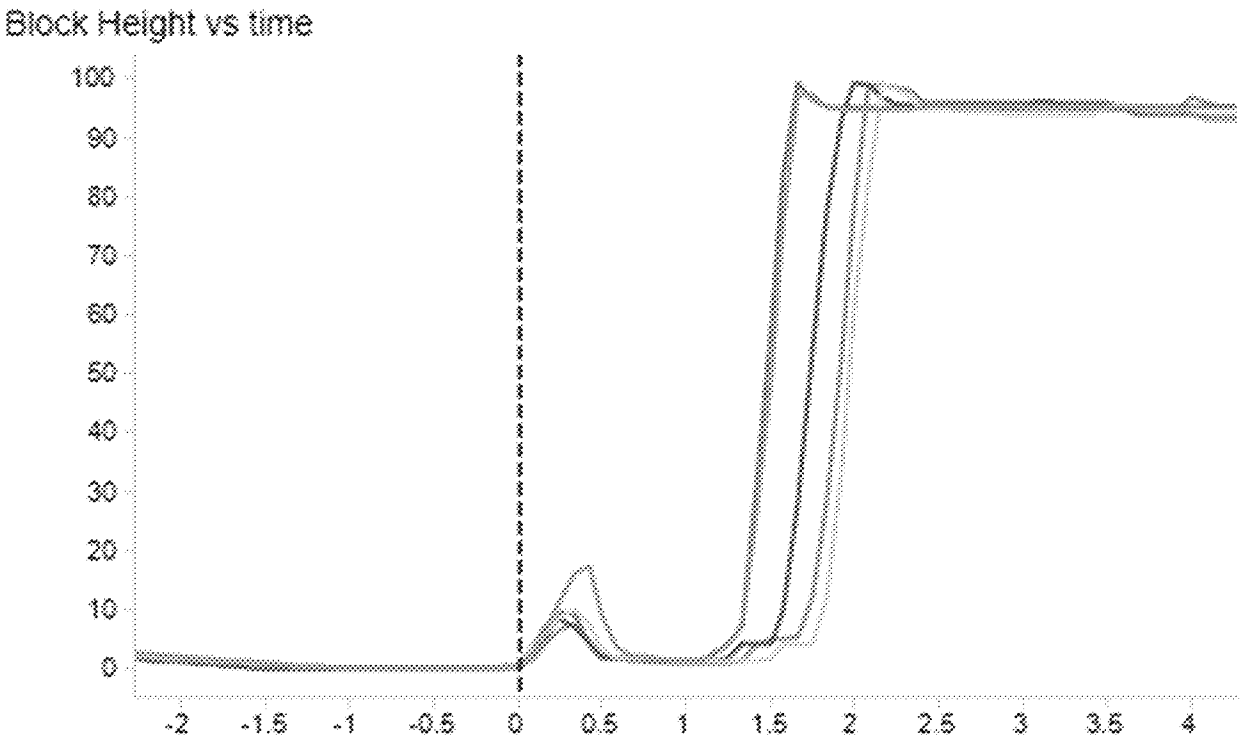
FIGS. 4A, 4B, 4C, 4D, 4E, and 4F illustrate example time-aligned plots of operating values of drilling operations.
Figure 4B:
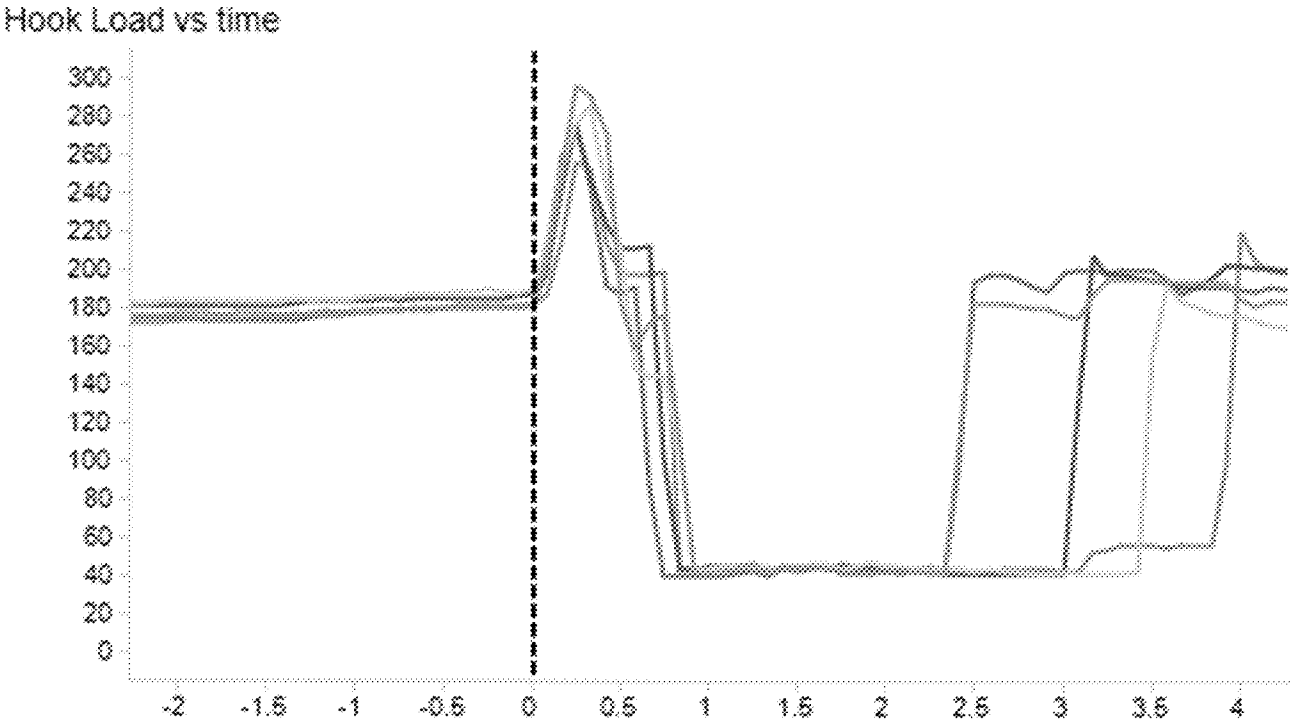
Figure 4C:
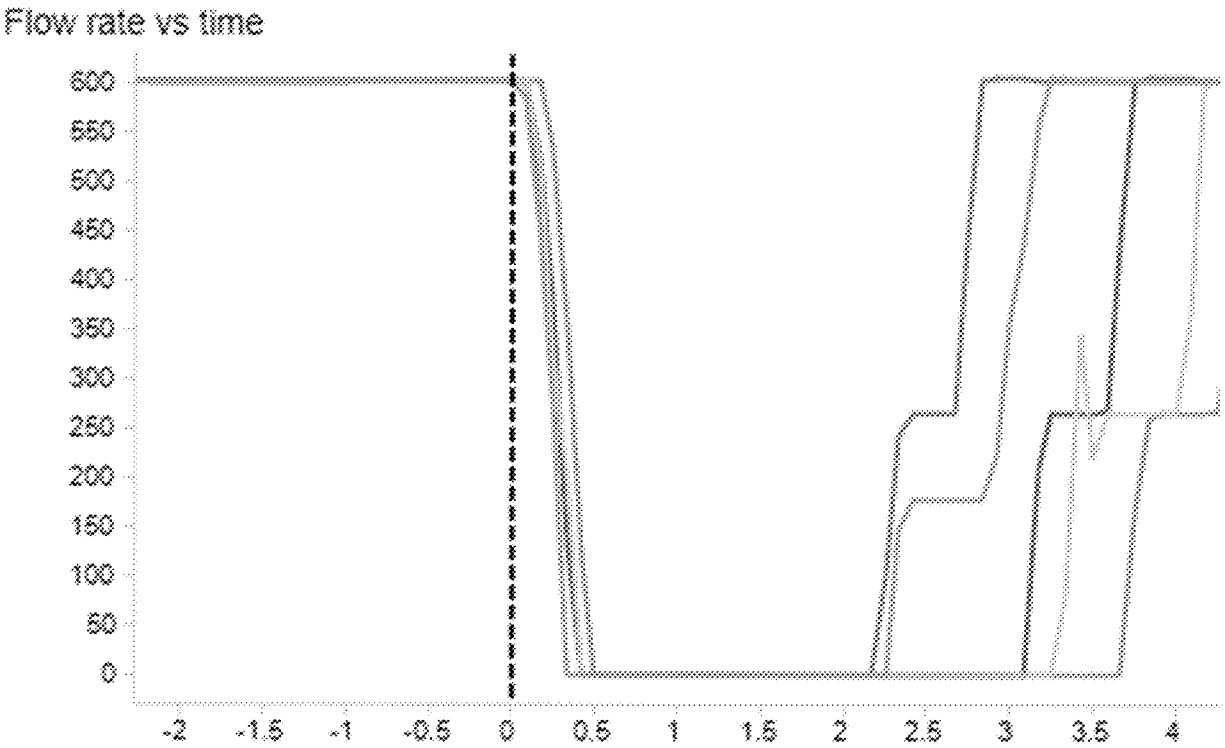
Figure 4D:
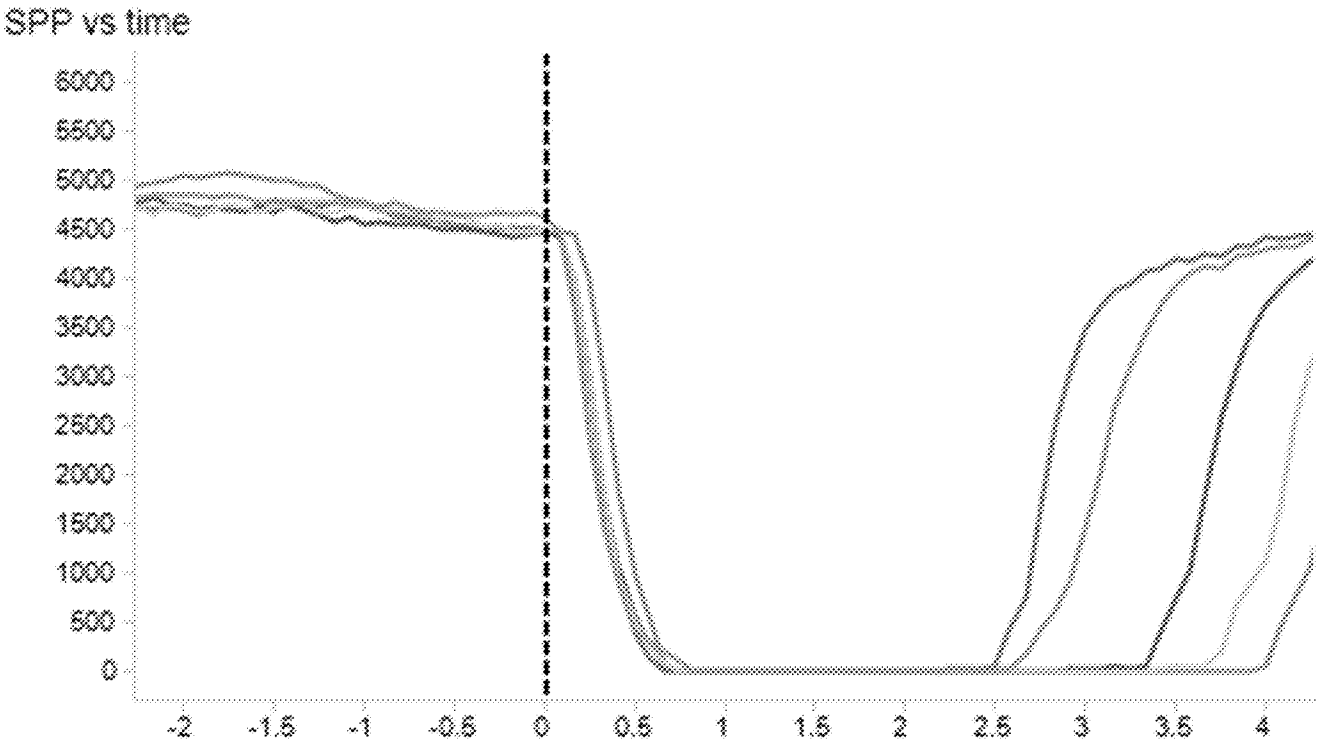
Figure 4E:
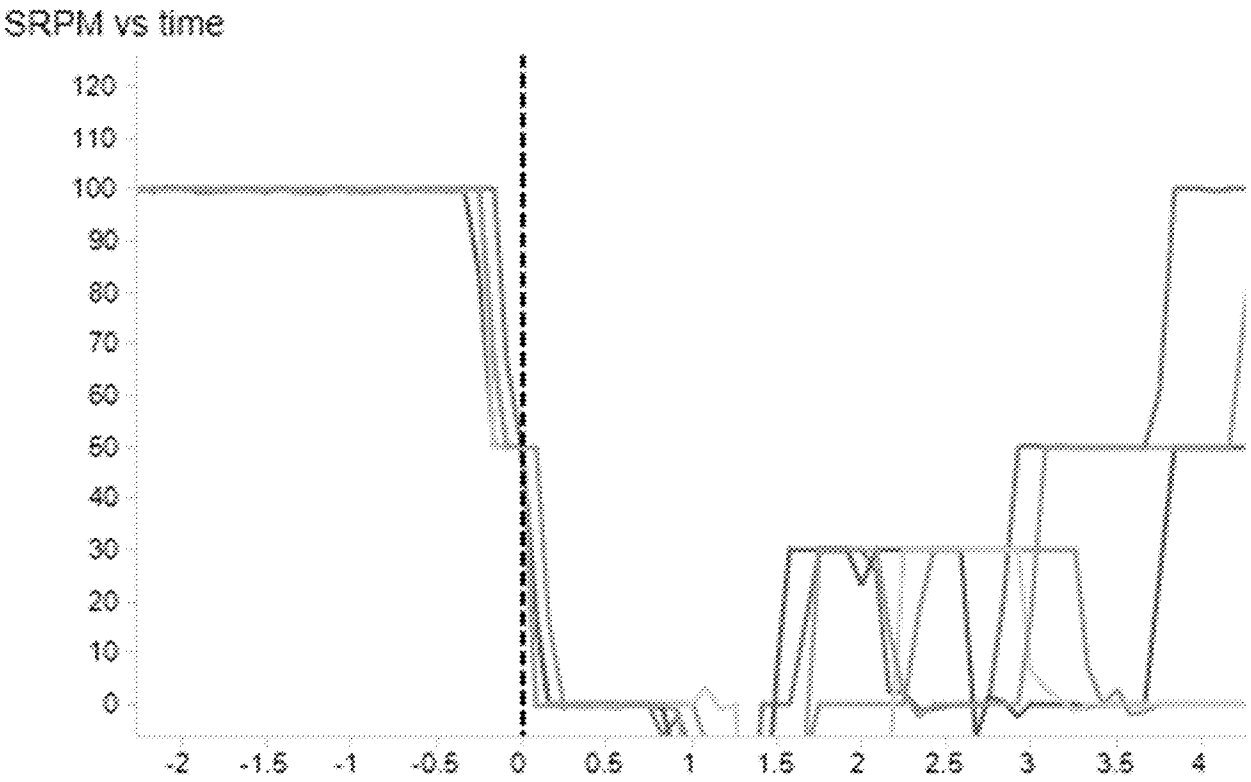
Figure 4F:
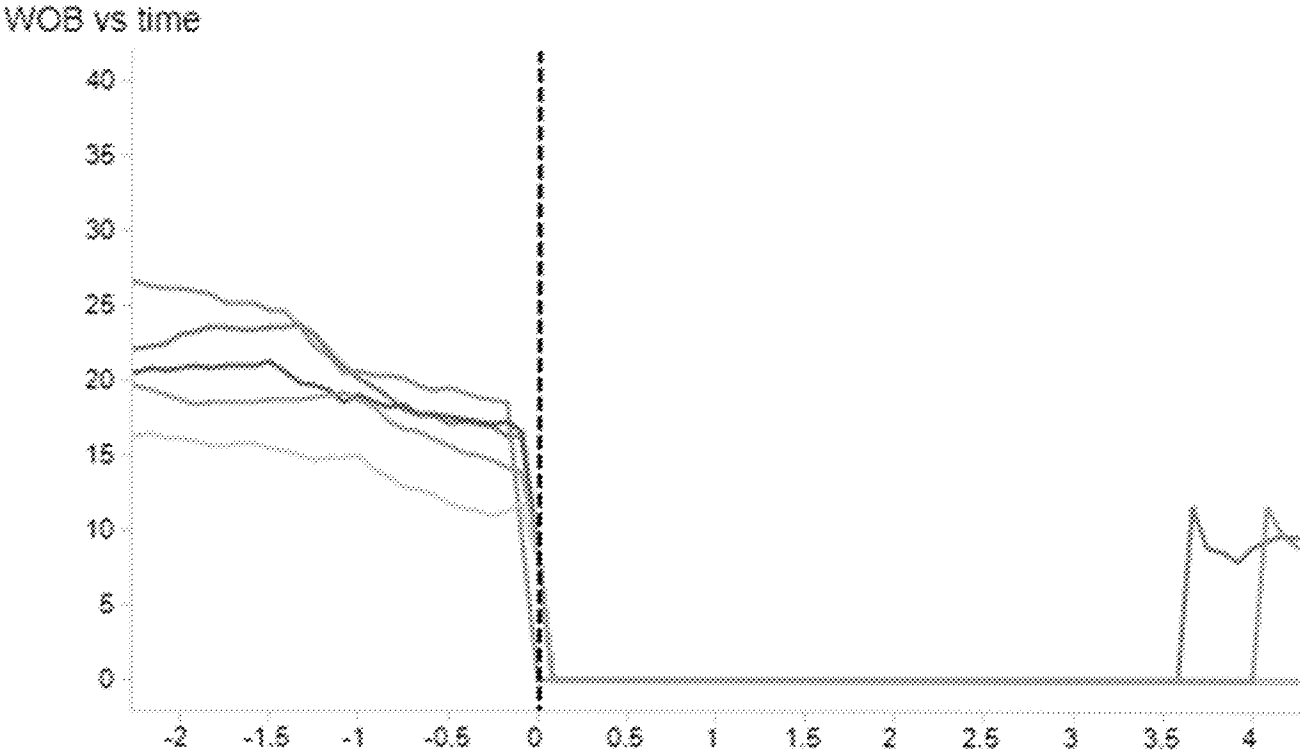

For example, the time-aligned plot 410 in FIG. 4A may show time-aligned values of block height for five pre-connection operations within the operation time windows 302, 304, 306, 308, 310. The time-aligned plot 420 in FIG. 4B may show time-aligned values of hook load for five pre-connection operations within the operation time windows 302, 304, 306, 308, 310. The time-aligned plot 430 in FIG. 4C may show time-aligned values of flow rate for five pre-connection operations within the operation time windows 302, 304, 306, 308, 310. The time-aligned plot 440 in FIG. 4D may show time-aligned values of standpipe pressure for five pre-connection operations within the operation time windows 302, 304, 306, 308, 310. The time-aligned plot 450 in FIG. 4E may show time-aligned values of surface RPM for five pre-connection operations within the operation time windows 302, 304, 306, 308, 310. The time-aligned plot 460 in FIG. 4F may show time-aligned values of weight on bit for five pre-connection operations within the operation time windows 302, 304, 306, 308, 310.

In some implementations, one or more visualizations of the time-aligned portions of the operating information may be generated and/or presented. For example, two dashboards may be generated for the two anchor points: a pre-connection practices dashboard and a post-connection practices dashboard. The dashboards may include one chart per monitored parameters (e.g., block height, hook load, flow rate, standpipe pressure, surface RPM, weight on bit), with a horizontal time scale and a vertical parameter value scale. The anchor points (W2S anchor point, S2W anchor point) may be set at zero time, and the horizontal time scale may be adjusted to include a certain amount of time before the anchor point and a certain amount of time after the anchor point (e.g., include two minutes prior anchor point and thirteen minutes after anchor point). In some implementations, the dashboard(s) may enable multiple selection of connection indexes and/or connection depths. In some implementations, one or more probability values (e.g., P20, P80) may be calculated for individual parameters and presented as one or more superimposed plots. Other visualizations of the time-aligned operating information are contemplated.

In some implementations, one or more visualizations may be divided/split into different sections. Different sections may include information that describes different operations/practices. For example, the time of when string is set on slips for connection may be identified as an on-slip point. The visualization(s) may be split into the following five sections based on time of occurrences: Section A: from start time to W2S anchor point (describes drilling operations and drill off practices); Section B: W2S anchor point to strings put on slips (on-slip point) (describes pre connection practices); Section C: on slip point to S2W anchor point (describes connection practices); Section D: S2W anchor point to bit on bottom point (describes post connection practices); and Section E: on bottom point to end time (describes start of drilling practices). Other divisions/sectioning of the visualization(s) are contemplated.

The analysis component 110 may be configured to perform multi-dimensional analysis of the time-aligned portions of the operating information, and/or other information. Multi-dimensional analysis of the time-aligned portions of the operating information may include examination, processing, studying, and/or other analysis of multiple dimensions of the time-aligned portions of the operating information. For example, multi-dimensional analysis of the time-aligned portions of the operating information may include performance of statistical analysis on one or more dimensions of the operating information to calculate minimums, averages, maximums, and/or other probabilities characteristics of the dimension(s) of the operating information. Other analysis of the time-aligned portions of the operating information are contemplated.

A dimension of the operating information may refer to a particular measurement contained in the operating information. Different dimensions of the operating information may refer to measurements of different things and/or different types. In some implementations, a dimension of the operating information may be determined based on one or more measurements contained in the operating information. For example, dimensions of the operating information may include one or more of operation time (e.g., how long it took to perform an operation/part of an operation), operating values (e.g., drilling parameter values), ratios of the operating values (e.g., ratio of different drilling parameter values), and/or other dimensions, and the multi-dimensional analysis of the time-aligned portions of the operating information may include analysis based on operation times, the operating values, ratios of the operating values, and/or other dimensions of the operating information. Such analysis of the operating information may look beyond simply how long certain operations took to perform and enable context-aware examination of the operations.

In some implementations, the multi-dimensional analysis of the time-aligned portions of the operating information may include analysis of different dimensions of the operating information based on a type of the operation of interest, a type of the sub-operation of interest, and/or other information. Different types and/or different numbers of dimensions of the operating information may be used for multi-dimensional analysis based on the particular operation of interest and/or the particular sub-operation of interest.

In some implementations, the multi-dimensional analysis of the time-aligned portions of the operating information may include identification of points of interest. Points of interest may refer to particular values contained in and/or derived from the operating information, which may be used to determine enhanced performance measurements of the drilling operations. FIGS. 5A and 5B illustrate example points of interest for multi-dimensional analysis of time-aligned operating values of drilling operations. Some of all of the points of interest shown in FIGS. 5A and 5B may be identified to determine enhanced performance measurements of drilling operations, such as making a connection and/or other drilling operations.

An enhanced performance measurement may refer to a quantifiable measure used to evaluate drilling operations. An enhanced performance measurement may evaluate whether a particular operation was successfully/unsuccessfully performed and/or to what extent a particular operation was successfully/unsuccessfully performed. An enhanced performance measurement may be used as an enhanced key performance indicator for drilling operations. An enhanced performance measurement may be determined based on one or more points of interest, such as shown in FIGS. 5A and 5B, and/or other information. FIGS. 6A and 6B illustrate example enhanced performance measurements determined based on one or more points of interest shown in FIGS. 5A and 5B. Other enhanced performance measurements are contemplated.

Enhanced performance measurements may describe one or more aspects of the drilling operations (e.g., making a connection), such as drilling practices used to perform the drilling operations. Enhanced performance measurements may provide multi-dimensional evaluations of the drilling operations. For example, rather than simply tracking how long different operations took to perform, enhanced performance measurements may track how the operations were performed. The enhanced performance measurements of drilling operations may be compared with one or more rules/procedures, such as rules/procedures that define preferred drilling operations (drilling rules/procedures), to determine whether and/or to what extent the drilling operations complied with and/or deviated from the rule(s)/procedure(s). The enhanced performance measurements of drilling operations may be used to determine whether the drilling operations were correctly performed. The enhanced performance measurements of drilling operations may be used to identify which aspects of the drilling operations were not in compliance with the drilling rule(s)/procedure(s). The enhanced performance measurements of drilling operations may be used to determine how future drilling operations may be performed differently from the performed drilling operations to bring the drilling operations into compliance with the drilling rule(s)/procedure(s). The enhanced performance measurements of drilling operations may be used to determine how future drilling operations may be adjusted to improve drilling productive and/or non-productive times.

In some implementations, one or more of the points of interest and/or one or more of the enhanced performance measurements may be used as digital fingerprints of the drilling operations. In some implementations, one or more of the points of interest and/or one or more of the enhanced performance measurements may be used to determine digital fingerprints of the drilling operations. The digital fingerprints may be compared with drilling rule(s)/procedure(s) to evaluate compliance of the drilling operations with the drilling rule(s)/procedure(s). The digital fingerprints of drilling operations may be compared with each other to generate comparisons of drilling operations. Other usages of digital fingerprints are contemplated.

In some implementations, one or more of the points of interest and/or one or more of the enhanced performance measurements may be used to determine values of procedural compliance parameters. Procedural compliance parameters may refer to measurable factors that may be tracked to determine whether and/or to what extent a particular drilling operation complied with drilling rule(s)/procedure(s). Values of the procedural compliance parameters may be determined based on one or more points of interest (such as shown in FIGS. 5A and 5B), one or more enhanced performance measurements (such as shown in FIGS. 6A and 6B), and/or other information. For example, FIG. 7 illustrates example procedural compliance parameters, and values of one or more of these procedural compliance parameters may be determined based on one or more enhanced performance measurements shown in FIGS. 6A and 6B. The values of one or more the procedural compliance parameters may be compared with drilling rule(s)/procedure(s) to determine compliance of the drilling operation with the drilling rule(s)/procedure(s). The values of one or more the procedural compliance parameters may reflect compliance of the drilling operation with the drilling rule(s)/procedure(s). The values of the procedural compliance parameters and/or the differences between the values of the procedural compliance parameters with the drilling rule(s)/procedure(s) may provide actionable insights on how the drilling operations may be changed to bring the drilling operations into compliance with the drilling rule(s)/procedure(s). For example, the values of the procedural compliance parameters and/or the differences between the values of the procedural compliance parameters with the drilling rule(s)/procedure(s) may provide information on whether and/or to what extent one or more operations may have been performed correctly/incorrectly (e.g., performed too quickly/slowly, performed with incorrect operating values, performed in wrong sequence), whether one or more operations may have been skipped, whether one or more operations are consistently being performed incorrectly, and/or other actionable insights into the drilling operations.

In some implementations, one or more of the points of interest and/or one or more of the enhanced performance measurements may be used to determine one or more rules and/or one or more procedures for drilling operations. The rule(s)/procedure(s) for drilling operations may define one or more of operations to be performed, ordering of operations, timing of operations, drilling tools to be used, operating values to be used, and/or other aspects of the drilling operations. For example, rule(s)/procedure(s) for recommended drilling practices may be generated based on one or more of digital fingerprints, S2W and W2S dashboards, probability (e.g., P20 and P80) curves, and/or other information. Rule(s)/procedure(s) for recommended drilling practices may be generated based on one or more enhanced performance measurements and/or other information.

The visualization component 112 may be configured to generate one or more visualizations of the drilling operations based on the multi-dimensional analysis of the time-aligned portions of the operating information, and/or other information. In some implementations, the visualization(s) may be generated for presentation and/or storage. A visualization of a drilling operation may refer to visual representation of the drilling operation. A visualization of a drilling operation may visually represent one or more aspects of the drilling operations. For example, a visualization of a drilling operation may visually represent operating values of the drilling operation, points of interest of the drilling operation, enhanced performance measurements of the drilling operation, results of the drilling operation, and/or other information relating to the drilling operation. A visualization of a drilling operation may visually represent quantitative and qualitative data relating to the performance of the drilling operation. A visualization of a drilling operation may be used to validate and/or analyze one or more portions of the operation (e.g., sub-steps of a drilling connection operation). In some implementations, the visualization(s) of the drilling operations may include one or more graphs (e.g., line graphs, bar graphs, pie charts).

Figure 8A:
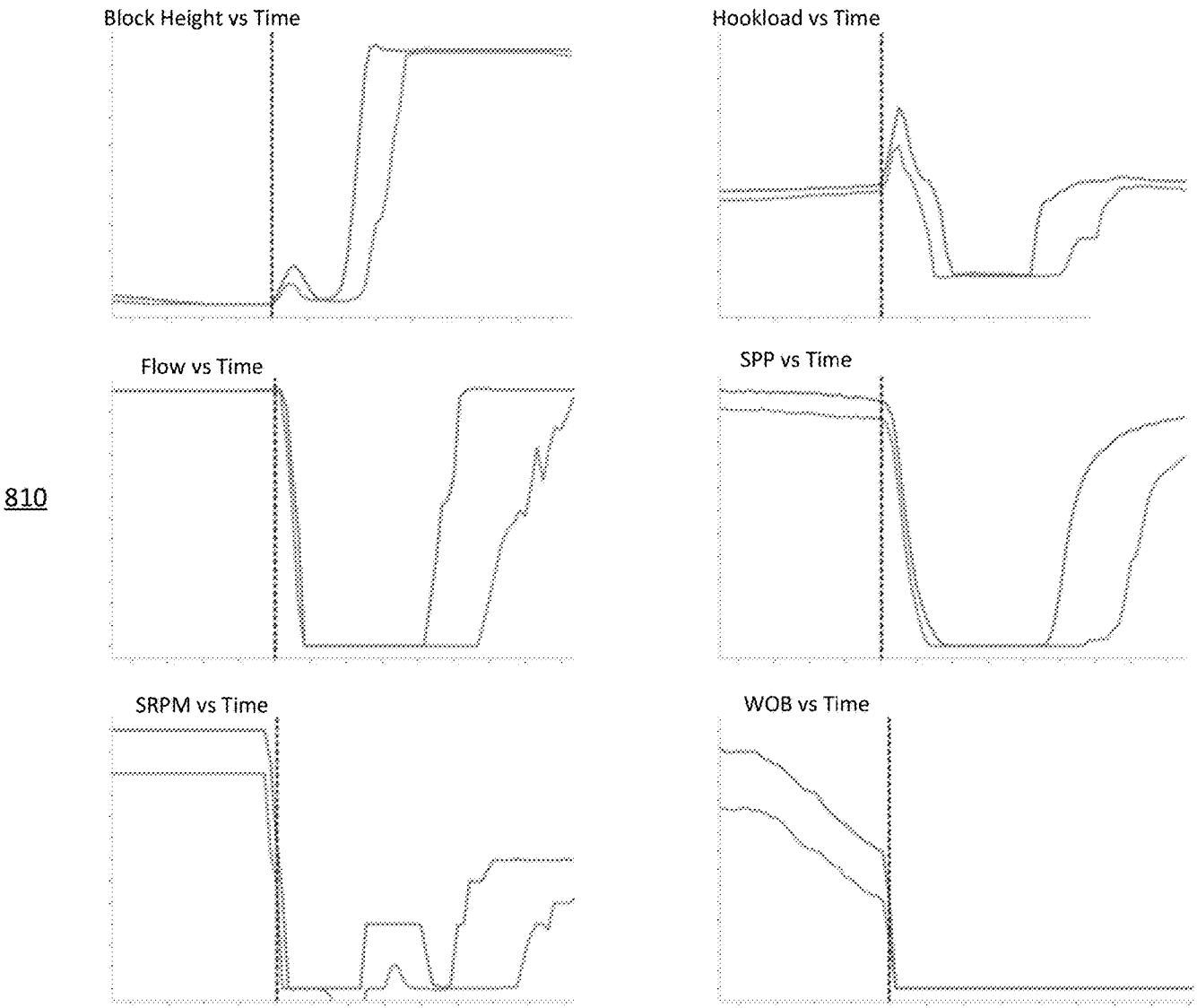
FIGS. 8A and 8B illustrate example visualizations of drilling operations.
Figure 8B:
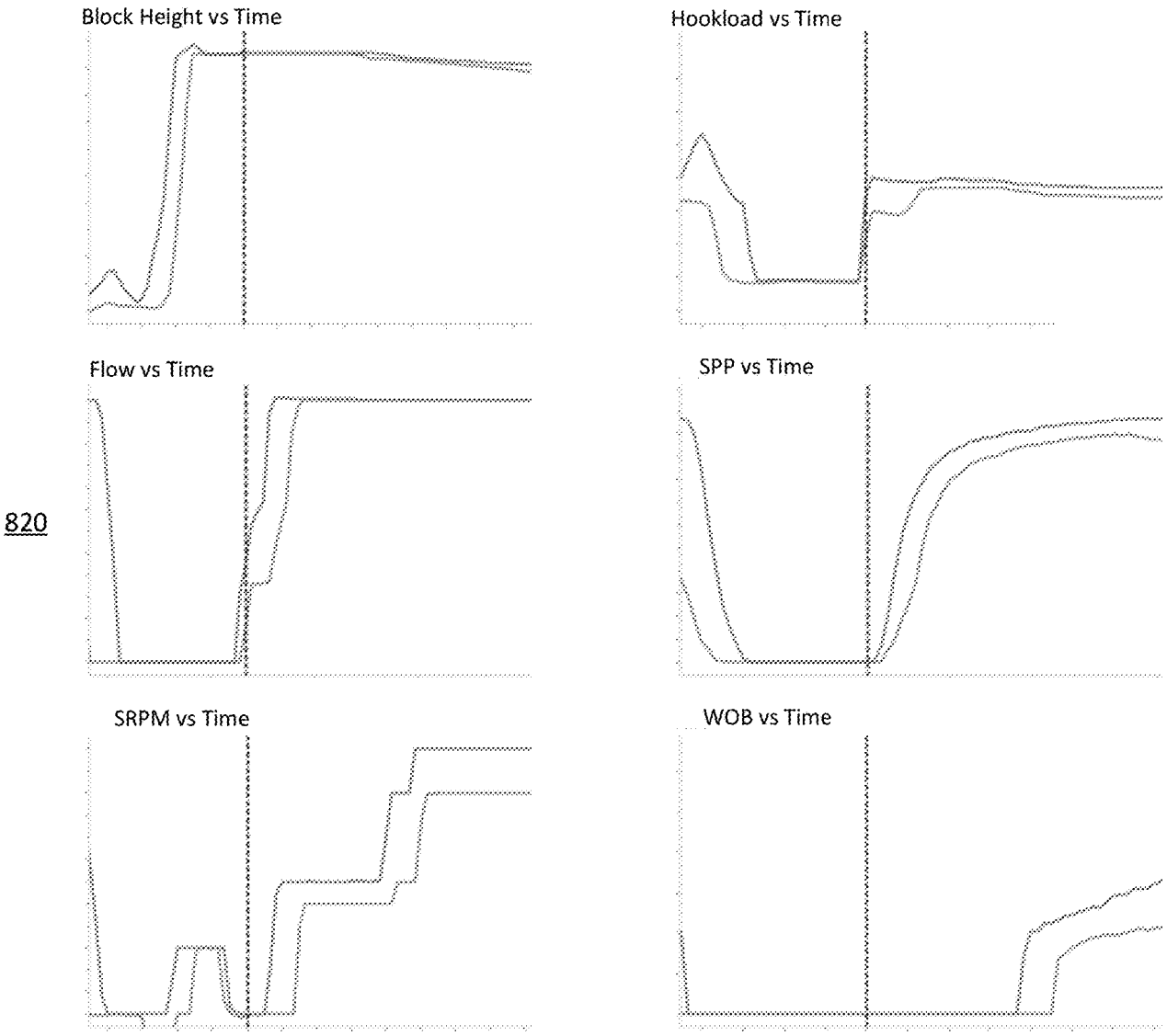

FIGS. 8A and 8B illustrate example visualizations 810, 820 of drilling operations. The visualization 810 of drilling operations shown in FIG. 8A may include plots of P20 and P80 curves for pre-connection practices, such as W2S block height, hook load, flow rate, standpipe pressure, surface RPM, weight on bit as a function of time. The visualization 820 of drilling operations shown in FIG. 8B may include plots of P20 and P80 curves for post-connection practices, such as S2W block height, hook load, flow rate, standpipe pressure, surface RPM, weight on bit as a function of time. The values of the plots and/or the shapes of the plots may be used as digital fingerprints of the drilling operations. Other graphical visualizations are contemplated.

FIGS. 9A, 9B, 9C, and 9D illustrate example visualizations 910, 920, 930, 940 of drilling operations. The visualizations 910, 920, 930, 940 may provide compliance visualization for the drilling operations. A compliance visualization for a drilling operation may refer to visual representation of compliance of the drilling operation with respect to drilling rule(s)/procedure(s). A compliance visualization for a drilling operation may visually represent whether and/or to what extent the drilling operations complied with and/or deviated from the rule(s)/procedure(s) for drilling. A compliance visualization may provide detailed information on aspects of the drilling operations that did and/or did not comply with the rule(s)/procedure(s). A compliance visualization may facilitate development of modifications to drilling plans/practices so that future drilling operations are performed in accordance with the rule(s)/procedure(s).

Figure 9A:
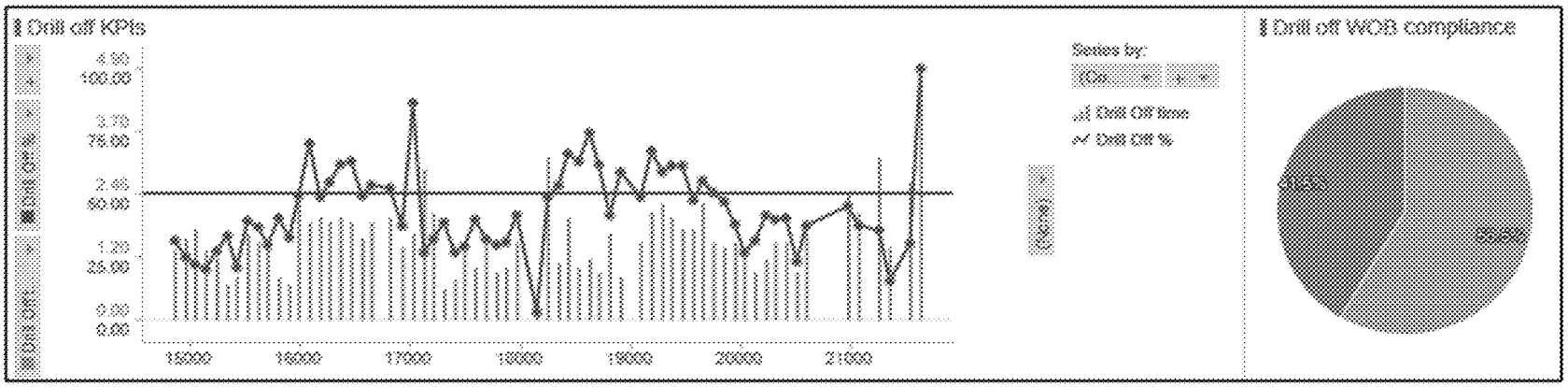
FIGS. 9A, 9B, 9C, and 9D illustrate example visualizations of drilling operations.

For example, the visualization 910 in FIG. 9A may visually represent drill off weight-on-bit compliance. The visualization 910 may include plots of drilling off time and corresponding drill off percentages. The visualization 910 may include a pie chart that provides a breakdown of percentage of drilling operations that complied with and did not comply with the drill off weight-on-bit rule/procedure, such as drilling off WOB to half within one minute. For instance, the pie chart included within the visualization 910 may indicate that 58.5% of connections drilled off WOB to half within one minute while 41.5% of connections did not drill off WOB to half within one minute.

Figure 9B:
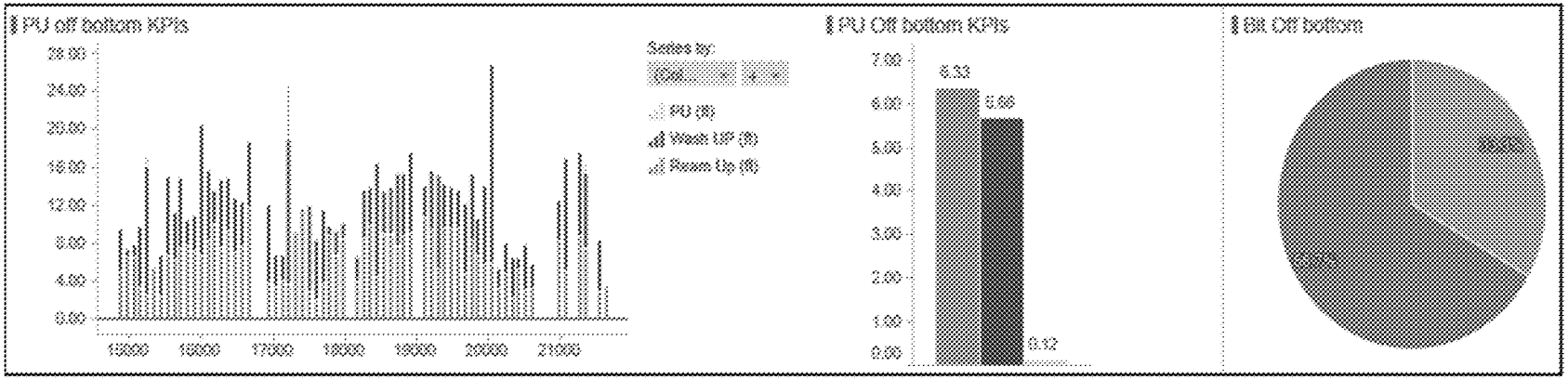

The visualization 920 in FIG. 9B may visually represent bit off bottom compliance. The visualization 920 may include plots of pick up, wash up, and ream up. The visualization 920 may include a pie chart that provides a breakdown of percentage of drilling operations that complied with and did not comply with the bit off bottom rule/procedure, such as overcoming pipe stretch at connection. For instance, the pie chart included within the visualization 920 may indicate that 66.7% of connections overcame pipe stretch at connection while 33.3% of connections did not overcome pipe stretch at connection.

Figure 9C:
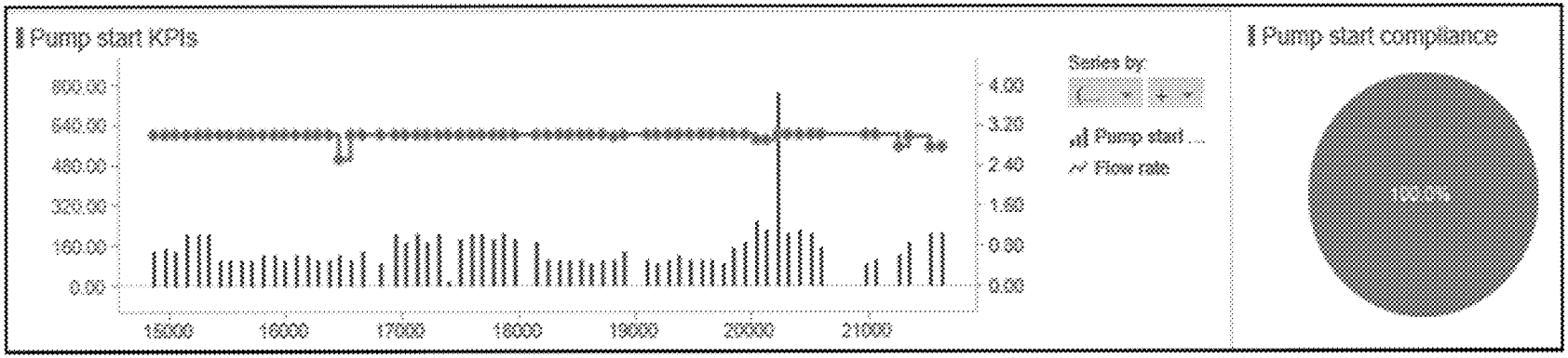

The visualization 930 in FIG. 9C may visually represent pump start compliance. The visualization 930 may include plots of pump start and flow rate. The visualization 930 may include a pie chart that provides a breakdown of percentage of drilling operations that complied with and did not comply with the pump start rule/procedure, such as pumps starting hard and not stepping up. For instance, the pie chart included within the visualization 930 may indicate that 100% of connections had pumps started up and 0% of connections had pumps that stepped up.

Figure 9D:
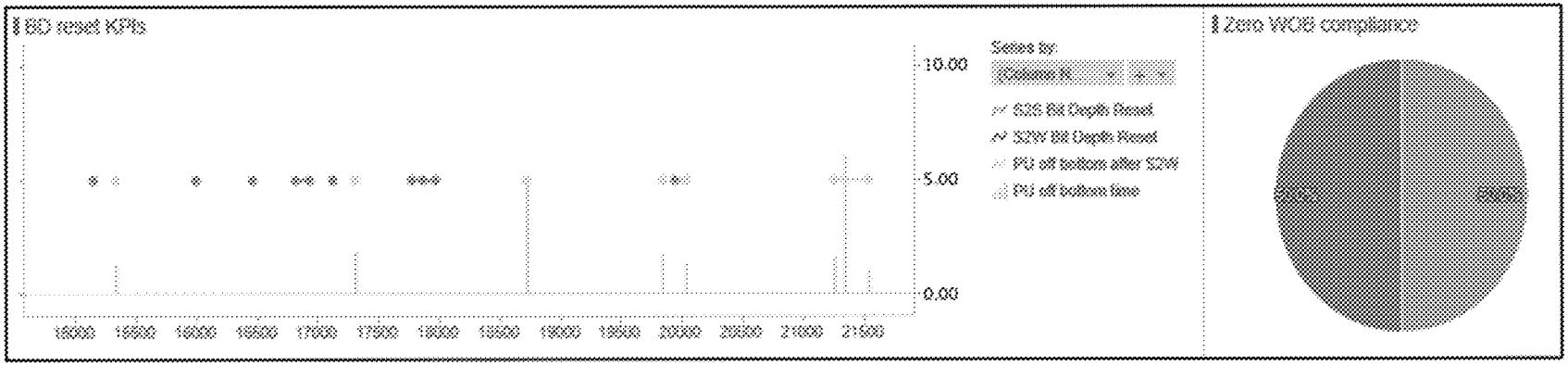

The visualization 940 in FIG. 9D may visually represent zero weight on bit compliance. The visualization 940 may include plots of S2S (slip-to-slip) bit depth reset, S2W (slip-to-weight) bit depth reset, pick up off bottom after S2W, and pick up off bottom time. The visualization 940 may include a pie chart that provides a breakdown of percentage of drilling operations that complied with and did not comply with the zero WOB rule/procedure. For instance, the pie chart included within the visualization 940 may indicate that 50% of connections did not have zero WOB while 50% of connections had zero WOB. Other visualizations are contemplated.

In some implementations, one or more of the visualizations 910, 920, 930, 940 may include and/or may be accompanied by visual and/or audible alerts. The alerts may be triggered responsive to non-compliance of the drilling operations. The alerts may be triggered responsive to non-compliance of one or more parts of the drilling operations (e.g., generation of an alarm for bit off bottom and zero weight on bit non-compliance). Other types of alerts are contemplated.

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11 and the electronic storage 13 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11 is shown in FIG. 1 as a single entity, this is for illustrative purposes only. In some implementations, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
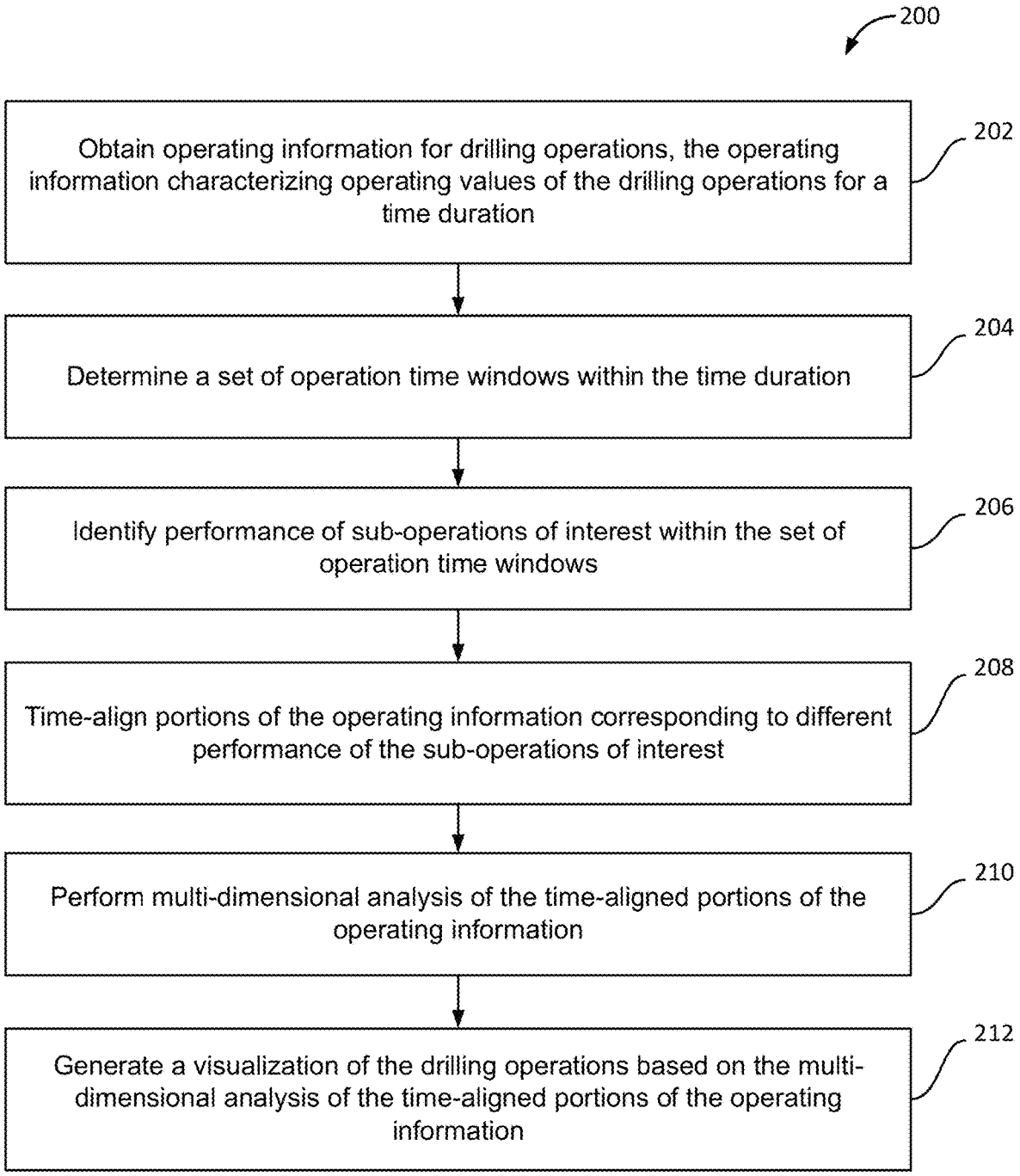
FIG. 2 illustrates an example method for automatically evaluating drilling operations.

FIG. 2 illustrates method 200 for automatically evaluating drilling operations. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operations of method 200 in response to instructions stored electronically on one or more electronic storage media. The one or more processing devices may include one or more devices configured through hardware, firmware, and/or software to be specifically designed for execution of one or more of the operations of method 200.

Referring to FIG. 2 and method 200, at operation 202, operating information for drilling operations and/or other information may be obtained. The operating information may characterize operating values of the drilling operations for one or more time durations. In some implementation, operation 202 may be performed by a processor component the same as or similar to the operating information component 102 (Shown in FIG. 1 and described herein).

At operation 204, a set of operation time windows within the time duration(s) may be determined. Individual operation time window may span a time portion within the time duration(s). Individual operation time window may correspond to performance of an operation of interest. The set of operation time windows may include a first operation time window, a second operation time window, and/or other operation time windows. The first operation time window may span a first time portion within the time duration(s). The first operation time window may correspond to first performance of a first operation of interest. The second operation time window may span a second time portion within the time duration(s). The second operation time window may correspond to second performance of the first operation of interest. In some implementation, operation 204 may be performed by a processor component the same as or similar to the operation component 104 (Shown in FIG. 1 and described herein).

At operation 206, performance of sub-operations of interest within the set of operation time windows may be identified. The performance of the sub-operations of interest may include first performance of a first sub-operation of interest within the first operation time window, second performance of the first sub-operation of interest within the second operation time window, and/or other performance of the first sub-operation of interest. In some implementation, operation 206 may be performed by a processor component the same as or similar to the sub-operation component 106 (Shown in FIG. 1 and described herein).

At operation 208, portions of the operating information corresponding to different performance of the sub-operations of interest may be time-aligned such that a first set of the operating values for the first performance of the first sub-operation of interest is time-aligned to a second set of the operating values for the second performance of the first sub-operation of interest. In some implementation, operation 208 may be performed by a processor component the same as or similar to the alignment component 108 (Shown in FIG. 1 and described herein).

At operation 210, multi-dimensional analysis of the time-aligned portions of the operating information may be performed. In some implementation, operation 210 may be performed by a processor component the same as or similar to the analysis component 110 (Shown in FIG. 1 and described herein).

At operation 212, one or more visualizations of the drilling operations may be generated based on the multi-dimensional analysis of the time-aligned portions of the operating information, and/or other information. In some implementation, operation 212 may be performed by a processor component the same as or similar to the visualization component 112 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system that automatically evaluates drilling operations, the system comprising:

one or more physical processors configured by machine-readable instructions to:

obtain operating information for the drilling operations, the operating information characterizing operating values of the drilling operations for a time duration;

determine a set of operation time windows within the time duration, individual operation time window spanning a time portion within the time duration and corresponding to performance of an operation of interest, wherein the set of operation time windows includes a first operation time window spanning a first time portion within the time duration and a second operation time window spanning a second time portion within the time duration, the first operation time window corresponding to first performance of a first operation of interest and the second operation time window corresponding to second performance of the first operation of interest;

identify performance of sub-operations of interest within the set of operation time windows, the performance of the sub-operations of interest including first performance of a first sub-operation of interest within the first operation time window and second performance of the first sub-operation of interest within the second operation time window;

time-align portions of the operating information corresponding to different performance of the sub-operations of interest such that a first set of the operating values for the first performance of the first sub-operation of interest is time-aligned to a second set of the operating values for the second performance of the first sub-operation of interest;

perform multi-dimensional analysis of the time-aligned portions of the operating information; and generate a visualization of the drilling operations based on the multi-dimensional analysis of the time-aligned portions of the operating information.

2. The system of claim 1, wherein the visualization of the drilling operations provides compliance visualization for the drilling operations.

3. The system of claim 2, wherein the visualization of the drilling operations includes one or more graphs.

4. The system of claim 1, wherein:

the performance of the sub-operations of interest further include first performance of a second sub-operation of interest within the first operation time window and second performance of the second sub-operation of interest within the second operation time window; and the portions of the operating information corresponding to different performance of the sub-operations of interest are time-aligned such that a third set of the operating values for the first performance of the second sub-operation of interest is time-aligned to a fourth set of the operating values for the second performance of the second sub-operation of interest.

5. The system of claim 1, wherein the multi-dimensional analysis of the time-aligned portions of the operating information includes analysis based on operation times, the operating values, and ratios of the operating values.

6. The system of claim 1, wherein the multi-dimensional analysis of the time-aligned portions of the operating information includes analysis of different dimensions of the operating information based on a type of the operation of interest and/or a type of the sub-operation of interest.

7. The system of claim 1, wherein the determination of the set of operation time windows within the time duration includes:

identification in time of occurrence of individual operation of interest; and selection of a corresponding operation time window to include a first time segment and a second time segment of the time duration, the first time segment preceding the occurrence of the individual operation of interest and the second time segment following the occurrence of the individual operation of interest.

8. The system of claim 7, wherein the first time segment and the second time segment are of same duration of time.

9. The system of claim 7, wherein the first time segment and the second time segment are of different durations of time.

10. The system of claim 1, wherein the time-alignment of the portions of the operating information corresponding to different performance of the sub-operations of interest includes:

identification in time of an anchoring point for individual sub-operation of interest; and alignment of the portions of the operating information corresponding to different performance of the sub-operations of interest such that multiple ones of the anchoring point are aligned.

11. A method for automatically evaluating drilling operations, the method comprising:

obtaining operating information for the drilling operations, the operating information characterizing operating values of the drilling operations for a time duration;

determining a set of operation time windows within the time duration, individual operation time window spanning a time portion within the time duration and corresponding to performance of an operation of interest, wherein the set of operation time windows includes a first operation time window spanning a first time portion within the time duration and a second operation time window spanning a second time portion within the time duration, the first operation time window corresponding to first performance of a first operation of interest and the second operation time window corresponding to second performance of the first operation of interest;

identifying performance of sub-operations of interest within the set of operation time windows, the performance of the sub-operations of interest including first performance of a first sub-operation of interest within the first operation time window and second performance of the first sub-operation of interest within the second operation time window;

time-aligning portions of the operating information corresponding to different performance of the sub-operations of interest such that a first set of the operating values for the first performance of the first sub-operation of interest is time-aligned to a second set of the operating values for the second performance of the first sub-operation of interest;

performing multi-dimensional analysis of the time-aligned portions of the operating information; and generating a visualization of the drilling operations based on the multi-dimensional analysis of the time-aligned portions of the operating information.

12. The method of claim 11, wherein the visualization of the drilling operations provides compliance visualization for the drilling operations.

13. The method of claim 12, wherein the visualization of the drilling operations includes one or more graphs.

14. The method of claim 11, wherein:

the performance of the sub-operations of interest further include first performance of a second sub-operation of interest within the first operation time window and second performance of the second sub-operation of interest within the second operation time window; and the portions of the operating information corresponding to different performance of the sub-operations of interest are time-aligned such that a third set of the operating values for the first performance of the second sub-operation of interest is time-aligned to a fourth set of the operating values for the second performance of the second sub-operation of interest.

15. The method of claim 11, wherein the multi-dimensional analysis of the time-aligned portions of the operating information includes analysis based on operation times, the operating values, and ratios of the operating values.

16. The method of claim 11, wherein the multi-dimensional analysis of the time-aligned portions of the operating information includes analysis of different dimensions of the operating information based on a type of the operation of interest and/or a type of the sub-operation of interest.

17. The method of claim 11, wherein determining the set of operation time windows within the time duration includes:

identifying in time occurrence of individual operation of interest; and selecting a corresponding operation time window to include a first time segment and a second time segment of the time duration, the first time segment preceding the occurrence of the individual operation of interest and the second time segment following the occurrence of the individual operation of interest.

18. The method of claim 17, wherein the first time segment and the second time segment are of same duration of time.

19. The method of claim 17, wherein the first time segment and the second time segment are of different durations of time.

20. The method of claim 11, wherein time-aligning the portions of the operating information corresponding to different performance of the sub-operations of interest includes:

identifying in time an anchoring point for individual sub-operation of interest; and aligning the portions of the operating information corresponding to different performance of the sub-operations of interest such that multiple ones of the anchoring point are aligned.

* * * * *